US010457065B2

(12) United States Patent
Kobayashi et al.

(10) Patent No.: US 10,457,065 B2
(45) Date of Patent: Oct. 29, 2019

(54) LIQUID CONTAINER

(71) Applicant: Seiko Epson Corporation, Tokyo (JP)

(72) Inventors: Atsushi Kobayashi, Matsumoto (JP); Koichi Toba, Shiojiri (JP); Yasuhiko Yoshikawa, Matsumoto (JP); Ryoichi Tanaka, Shiojiri (JP); Tadahiro Mizutani, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/873,586

(22) Filed: Jan. 17, 2018

(65) Prior Publication Data

US 2018/0207946 A1 Jul. 26, 2018

(30) Foreign Application Priority Data

Jan. 25, 2017 (JP) ..... 2017-010857
May 30, 2017 (JP) ..... 2017-106444

(51) Int. Cl.
*B41J 2/21* (2006.01)
*B41J 2/175* (2006.01)
*B41J 2/19* (2006.01)

(52) U.S. Cl.
CPC ..... *B41J 2/211* (2013.01); *B41J 2/17513* (2013.01); *B41J 2/17523* (2013.01); (Continued)

(58) Field of Classification Search
CPC .... B41J 2/211; B41J 2/17513; B41J 2/17523; B41J 2/17553; B41J 2/19; B41J 2002/17516
See application file for complete search history.

(56) References Cited

U.S. PATENT DOCUMENTS 6,007,191 A 12/1999 Fujii et al.
6,012,808 A 1/2000 Koitabashi et al.
(Continued)

FOREIGN PATENT DOCUMENTS

CN 201099043 Y 8/2008
CN 103568576 A 2/2014
(Continued)

OTHER PUBLICATIONS

IP.com search (Year: 2019).*

*Primary Examiner* — Lisa Solomon
(74) *Attorney, Agent, or Firm* — Foley & Lardner LLP

(57) ABSTRACT

There is provided a liquid container that comprises an upper wall and a bottom wall; a liquid supply port provided in the bottom wall; a first chamber provided on a +Z direction side that is an upper wall side; a second chamber provided on a −Z direction side that is a bottom wall side; a partition wall configured to part the first chamber from the second chamber; and a connecting hole configured to connect the first chamber with the second chamber. The second chamber is connected with the liquid supply port. The first chamber is connected with the liquid supply port via the connecting hole and the second chamber. The second chamber includes a return flow path that is turned back along an X direction. A liquid contained in the first chamber is flowed from the connecting hole through the return flow path to the liquid supply port.

19 Claims, 32 Drawing Sheets

(52) U.S. Cl.
CPC ..... *B41J 2/17553* (2013.01); *B41J 2/19* (2013.01); *B41J 2002/17516* (2013.01)

(56) References Cited

U.S. PATENT DOCUMENTS

| | | | |
|---|---|---|---|
| 6,042,224 | A | 3/2000 | Oda et al. |
| 6,257,712 | B1 | 7/2001 | Haigo |
| 8,342,664 | B2 | 1/2013 | Wang |
| 9,308,735 | B2 * | 4/2016 | Nozawa ..... B41J 2/17553 |
| 9,649,847 | B2 | 5/2017 | Nozawa et al. |
| 2014/0022314 | A1 | 1/2014 | Nozawa et al. |
| 2014/0022317 | A1 | 1/2014 | Nozawa et al. |
| 2014/0043405 | A1 | 2/2014 | Mizutani et al. |
| 2014/0043406 | A1 | 2/2014 | Mizutani et al. |
| 2014/0060692 | A1 | 3/2014 | Nakamura et al. |
| 2014/0060693 | A1 | 3/2014 | Nakamura et al. |
| 2015/0298460 | A1 | 10/2015 | Nozawa et al. |
| 2016/0214390 | A1 | 7/2016 | Nozawa et al. |

FOREIGN PATENT DOCUMENTS

| | | | |
|---|---|---|---|
| EP | 0 727 314 | A2 | 8/1996 |
| EP | 2 719 537 | A2 | 4/2014 |
| JP | H06-040041 | A | 2/1994 |
| JP | 2004-090414 | A | 3/2004 |
| JP | 3807115 | B2 | 8/2006 |
| JP | 2014-040080 | A | 3/2014 |

* cited by examiner

LIQUID CONTAINER

CROSS-REFERENCE TO RELATED APPLICATION

The present application claims priority from Japanese patent application 2017-010857 filed on Jan. 25, 2017 and Japanese patent application 2017-106444 filed on May 30, 2017, the entireties of the contents of which are hereby incorporated by reference into this application.

BACKGROUND

Field

The disclosure relates to a liquid container configured to contain a liquid such as ink.

Related Art

JP 2014-40080A, JP 1106-40041A and JP 3807115B disclose various printers configured to introduce the air into a liquid container. The printers disclosed in JP 2014-40080A and JP 1106-40041A are "on-carriage type" printers in which a liquid container is mounted on a holder of a carriage that moves a print head. The printer described in JP 3807115B is an "off-carriage type" printer in which a liquid container is not mounted on a carriage but is placed at a stationary position.

In these various printers, air bubbles are likely to be mixed in ink that is supplied from the liquid container. The inflow of air bubbles to the print head in the printer is likely to cause a printing failure. This problem may be especially remarkable in the liquid container mounted to the on-carriage type printer like JP 2014-40080A and JP 1106-40041A, since ink in an ink chamber undulates during reciprocation of the carriage and is likely to be mixed with the air to produce air bubbles. This problem is not characteristic of the liquid container configured to introduce the air into the liquid container but may arise when a certain amount of the air is present in the liquid container. This problem is commonly found in liquid containers configured to contain liquids other than ink and liquid ejection apparatuses using such liquid containers.

SUMMARY (1) According to a first aspect of the present disclosure, there is provided a liquid container configured to be mounted to a carriage that reciprocates in an X direction. The liquid container comprises an upper wall and a bottom wall opposed to each other in a Z direction that intersects with the X direction; a first side wall and a second side wall opposed to each other in a Y direction that intersects with the X direction and the Z direction; a third side wall and a fourth side wall opposed to each other in the X direction; a liquid supply port provided in the bottom wall; a first chamber provided on a +Z direction side that is an upper wall side in the Z direction; a second chamber provided on a −Z direction side that is a bottom wall side in the Z direction; a partition wall configured to part the first chamber from the second chamber; and a connecting hole configured to connect the first chamber with the second chamber. The second chamber is connected with the liquid supply port. The first chamber is connected with the liquid supply port via the connecting hole and the second chamber. The second chamber includes a return flow path that is turned back along the X direction. A liquid contained in the first chamber is flowed from the connecting hole through the return flow path to the liquid supply port. In the liquid container of this aspect, the return flow path turned back along a moving direction of the liquid container is provided in the second chamber. This configuration reduces the possibility that air bubbles are mixed in the liquid supplied from the liquid container.

(2) In the liquid container of the above aspect, the return flow path may include a first flow path in which the liquid flows from the third side wall toward the fourth side wall, and a second flow path in which the liquid flows from the fourth side wall toward the third side wall. The liquid container of this configuration increases the flow path length of the return flow path.

(3) In the liquid container of the above aspect, the first chamber may be provided with an air introducing hole configured to introduce the air from outside of the first chamber into the first chamber. The liquid container of this configuration provides the good pressure state in the first chamber.

(4) In the liquid container of the above aspect, when a first chamber side of the return flow path is called upstream side and a liquid supply port side of the return flow path is called downstream side, a wall that forms an upper surface of a most downstream side flow path of the return flow path may include an inclined portion that is inclined to the +Z direction side from the downstream side toward the upstream side. The liquid container of this configuration enables air bubbles in the second chamber to be moved to the upstream side by using the buoyance of the air bubbles.

(5) In the liquid container of the above aspect, the partition wall may form an upper surface of a most upstream flow path of the return flow path. The partition wall may include an inclined portion that is inclined to the +Z direction side from the downstream side toward the upstream side. The liquid container of this configuration enables air bubbles in the second chamber to be moved to the further upstream side by using the buoyance of the air bubbles.

(6) In the liquid container of the above aspect, the connecting hole may have such dimensions and shape that allow for gas-liquid exchange between the first chamber and the second chamber. The liquid container of this configuration enables air bubbles in the second chamber to be moved to the first chamber.

(7) In the liquid container of the above aspect, the second chamber may include a space that is located on the +Z direction side of the return flow path and that is configured to accumulate air bubbles therein. The liquid container of this configuration enables air bubbles in the second chamber to be moved to the space located on the +Z direction side of the return flow path by using the buoyance of the air bubbles.

(8) In the liquid container of the above aspect, the space may be connected with the return flow path in the middle of the return flow path. The liquid container of this configuration causes air bubbles to be away from the first chamber and the liquid supply port.

(9) In the liquid container of the above aspect, the connecting hole may have such dimensions and shape that do not allow for gas-liquid exchange between the first chamber and the second chamber. The liquid container of this configuration suppresses air bubbles from moving from the second chamber to the first chamber and makes the air bubbles likely to be moved to the space described above.

(10) In the liquid container of the above aspect, the connecting hole may have a flow path sectional shape including at least a first polygon and a second polygon when the connecting hole is viewed in the Z direction. The first polygon and the second polygon may have different areas. In the liquid container of this configuration, the flow path sectional shape of the connecting hole provided to connect the first chamber with the second chamber includes the first polygon and the second polygon having different areas. This configuration accelerates gas-liquid exchange in the connecting hole and suppresses air bubbles from reaching the liquid supply port. This configuration thus more effectively reduces the possibility that air bubbles are mixed in the liquid supplied from the liquid container.

(11) In the liquid container of the above aspect, the return flow path may include a first flow path in which the liquid flows from the third side wall toward the fourth side wall, and a second flow path in which the liquid flows from the fourth side wall toward the third side wall. The liquid container of this configuration increases the flow path length of the return flow path.

(12) In the liquid container of the above aspect, a connecting portion between the first flow path and the second flow path may have a flow path sectional shape including at least a third polygon and a fourth polygon when the connecting portion is viewed in the Z direction. The third polygon and the fourth polygon may have different areas. The liquid container of this configuration accelerates gas-liquid exchange in the connecting portion between the first flow path and the second flow path. This configuration thus more effectively reduces the possibility that air bubbles are mixed in the liquid supplied from the liquid container.

(13) In the liquid container of the above aspect, a connecting portion between the first flow path and the second flow path may include a step that is formed on an inner surface of at least one of the first side wall and the second side wall to be extended in a direction from the upper wall toward the bottom wall. The liquid container of this configuration enables the liquid to be flowed along the step and thereby causes the liquid to be readily flowed from the first flow path to the second flow path.

(14) In the liquid container of the above aspect, a third flow path for liquid delivery configured to deliver the liquid from the second chamber to the liquid supply port and a fourth flow path for air delivery configured to deliver the air from the liquid supply port to the second chamber may be provided between the second chamber and the liquid supply port. The liquid container of this configuration accelerates gas-liquid exchange between the second chamber and the liquid supply port. This configuration thus more effectively reduces the possibility that air bubbles are mixed in the liquid supplied from the liquid container.

(15) In the liquid container of the above aspect, when a first chamber side of the return flow path is called upstream side and a liquid supply port side of the return flow path is called downstream side, a wall that forms an upper surface of a most downstream side flow path of the return flow path may include an inclined portion that is inclined to the +Z direction side from the downstream side toward the upstream side. The liquid container of this configuration enables air bubbles in the second chamber to be moved to the upstream side by using the buoyance of the air bubbles.

(16) In the liquid container of the above aspect, the partition wall may form an upper surface of a most upstream flow path of the return flow path. The partition wall may include an inclined portion that is inclined to the +Z direction side from a downstream side toward an upstream side. The liquid container of this configuration enables air bubbles in the second chamber to be moved to the further upstream side by using the buoyance of the air bubbles.

(17) In the liquid container of the above aspect, the second chamber may be provided with an air bubble storage portion including a space that is located on the +Z direction side of the return flow path and that is configured to accumulate air bubbles therein. The liquid container of this configuration enables air bubbles in the second chamber to be moved to the space located on the +Z direction side of the return flow path by using the buoyance of the air bubbles.

(18) In the liquid container of the above aspect, the air bubble storage portion may be connected with the return flow path in the middle of the return flow path. The liquid container of this configuration causes air bubbles to be away from the first chamber and the liquid supply port.

(19) In the liquid container of the above aspect, the return flow path may include a first flow path in which the liquid flows from the third side wall toward the fourth side wall, and a second flow path in which the liquid flows from the fourth side wall toward the third side wall. A connecting portion between the first flow path and the second flow path may have a flow path sectional shape including at least two polygons having different areas when the connecting portion is viewed in the Z direction. In the liquid container of this configuration, the return flow path turned back along the moving direction of the liquid container is provided in the second chamber. This configuration reduces the possibility that air bubbles are mixed in the liquid supplied from the liquid container. The flow path sectional shape of the connecting portion between the first flow path and the second flow path included in the return flow path includes at least two polygons having different areas. This configuration accelerates gas-liquid exchange in this connecting portion and suppresses air bubbles from reaching the liquid supply port. This configuration thus more effectively reduces the possibility that air bubbles are mixed in the liquid supplied from the liquid container.

(20) In the liquid container of the above aspect, a flow path for liquid delivery configured to deliver the liquid from the second chamber to the liquid supply port and a flow path for air delivery configured to deliver the air from the liquid supply port to the second chamber may be provided between the second chamber and the liquid supply port. In the liquid container of this configuration, the flow path for liquid delivery and the flow path for air delivery are provided between the second chamber and the liquid supply port. This configuration accelerates gas-liquid exchange between the second chamber and the liquid supply port and suppresses air bubbles from reaching the liquid supply port. This configuration thus more effectively reduces the possibility that air bubbles are mixed in the liquid supplied from the liquid container.

The present disclosure may be implemented by various aspects other than the aspects of the liquid container described above, for example, a printer equipped with the liquid container and a liquid supply system including the liquid container and a printer.

DETAILED DESCRIPTION

A. First Embodiment

Figure 1:
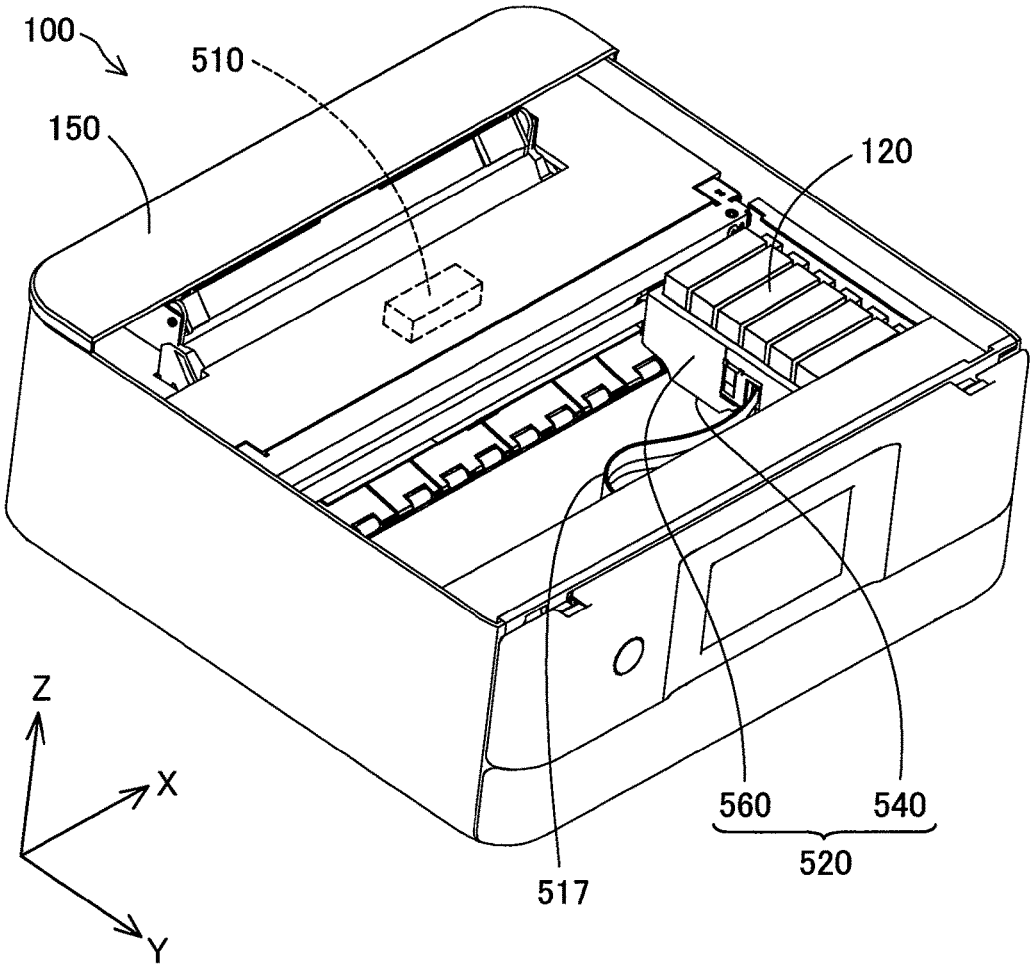
FIG. 1 is a perspective view illustrating the schematic configuration of a liquid supply system according to a first embodiment.

FIG. 1 is a perspective view illustrating the schematic configuration of a liquid supply system 100 according to a first embodiment. X, Y and Z axes that are orthogonal to one another are illustrated in FIG. 1. The X, Y and Z axes of FIG. 1 correspond to X, Y and Z axes of the other drawings. The liquid supply system 100 includes cartridges 120 as liquid containers and a printer 150 as a liquid ejection apparatus. In the liquid supply system 100, the cartridges 120 are mountable to a carriage 520 of the printer 150 by the user. According to this embodiment, "liquid" denotes ink.

The cartridge 120 of the liquid supply system 100 is configured to contain ink as a printing material (liquid) inside thereof. The ink contained in the cartridge 120 is supplied to a liquid ejection head 540 via a liquid supply port and a liquid introducing portion described later. According to this embodiment, a plurality of the cartridges 120 are detachably mounted to a holder 560 of the printer 150. The respective cartridges 120 contain different types of inks. The types of inks contained and the number of cartridges may be changed arbitrarily.

The printer 150 is a small-size inkjet printer for personal use. The printer 150 includes a controller 510 and the carriage 520. The carriage 520 includes a liquid ejection head 540 and the holder 560. The printer 150 causes the inks to be flowed from the cartridges 120 mounted to the holder 560 through the liquid introducing portion (described later) to the liquid ejection head 540 and to be ejected (supplied) from the liquid ejection head 540 onto a printing medium such as a sheet of paper or a label. This configuration causes characters, graphic, images and the like to be printed on the printing medium by using the liquid ejection head 540.

The controller 510 of the printer 150 controls the respective portions of the printer 150. The carriage 520 of the printer 150 is configured to move the liquid ejection head 540 relative to the printing medium. The liquid ejection head 540 of the printer 150 includes a liquid ejection mechanism configured to eject the liquids contained in the cartridges 120 onto the printing medium. The controller 510 and the carriage 520 are electrically interconnected by a flexible cable 517, and the liquid ejection mechanism of the liquid ejection head 540 operates, in response to control signals from the controller 510.

According to this embodiment, the carriage 520 is provided with the holder 560 along with the liquid ejection head 540. This type of printer 150 with the cartridges 120 mounted to the holder 560 on the carriage 520 that is configured to move the liquid ejection head 540 is also called "on-carriage type". According to another embodiment, a stationary, fixed holder 560 may be provided at a different position from the carriage 520, and the inks from the cartridges 120 mounted to the holder 560 may be supplied to the liquid ejection head 540 of the carriage 520 through a flexible tube. This type of printer is also called "off-carriage type".

The printer 150 includes a main scanning feed mechanism and a sub-scanning feed mechanism configured to move the carriage 520 and the printing medium relative to each other and implement printing on the printing medium. The main scanning feed mechanism of the printer 150 includes a carriage motor and a drive belt and is configured to transmit the power of the carriage motor via the drive belt to the carriage 520 and thereby reciprocate the carriage 520 in a main scanning direction. The sub-scanning feed mechanism of the printer 150 includes a feed motor and a platen and is configured to transmit the power of the feed motor to the platen and thereby feed the printing medium in a sub-scanning direction that is orthogonal to the main scanning direction. The carriage motor of the main scanning feed mechanism and the feed motor of the sub-scanning feed mechanism operate, in response to control signals from the controller 510.

According to this embodiment, in the use state (also called "use attitude") of the liquid supply system 100, an axis along the main scanning direction (left-right direction) in which the carriage 520 is reciprocated is specified as X axis; an axis along the sub-scanning direction (front-back direction) in which the printing medium is fed is specified as Y axis; and an axis along the direction of gravity (top-bottom direction) is specified as Z-axis. The use state of the liquid supply system 100 herein denotes the state of the liquid supply system 100 placed on a horizontal plane, and the horizontal plane denotes a plane parallel to the X axis and the Y axis (XY plane). The sub-scanning direction (forward direction) is +Y direction and its reverse direction (backward direction) is −Y direction; a direction from the bottom to the top along the direction of gravity (upward direction) is +Z direction, and its reverse direction (downward direction) is −Z direction. A +Y direction side (front side) forms a front face of the liquid supply system 100. According to this embodiment, a direction from a left side face to a right side face of the liquid supply system 100 is +X direction (rightward direction), and its reverse direction is −X direction (leftward direction). A direction along the X axis (left-right direction), i.e., the direction in which the carriage 520 is reciprocated, is also called "X direction", and a direction along the Z axis (top-bottom direction) is also called "Z direction". According to this embodiment, the direction of array of the cartridges 120 mounted to the holder 560 is Y direction. In other words, the cartridges 120 are arrayed on the carriage 520 in a direction (Y direction) perpendicular to the direction in which the carriage 520 is moved (X direction).

Figure 2:
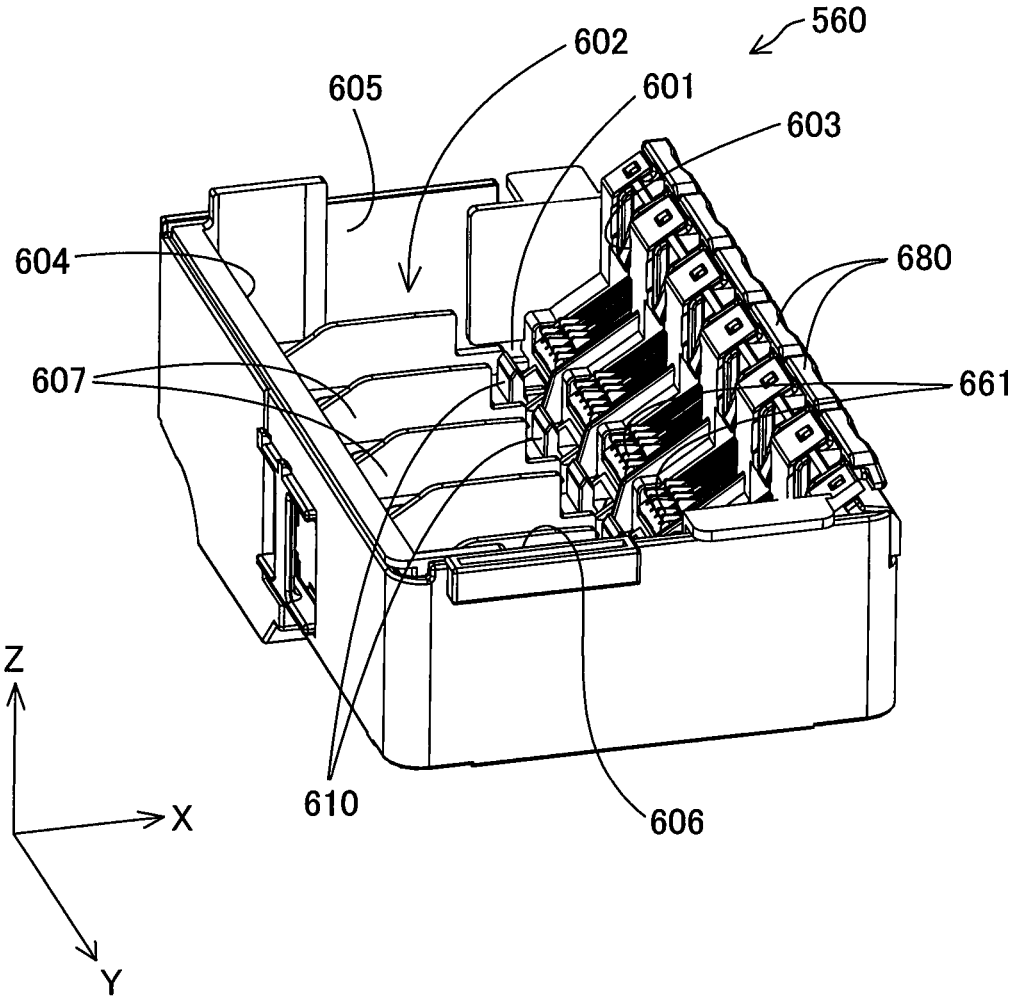
FIG. 2 is a perspective view illustrating a holder.
Figure 3:
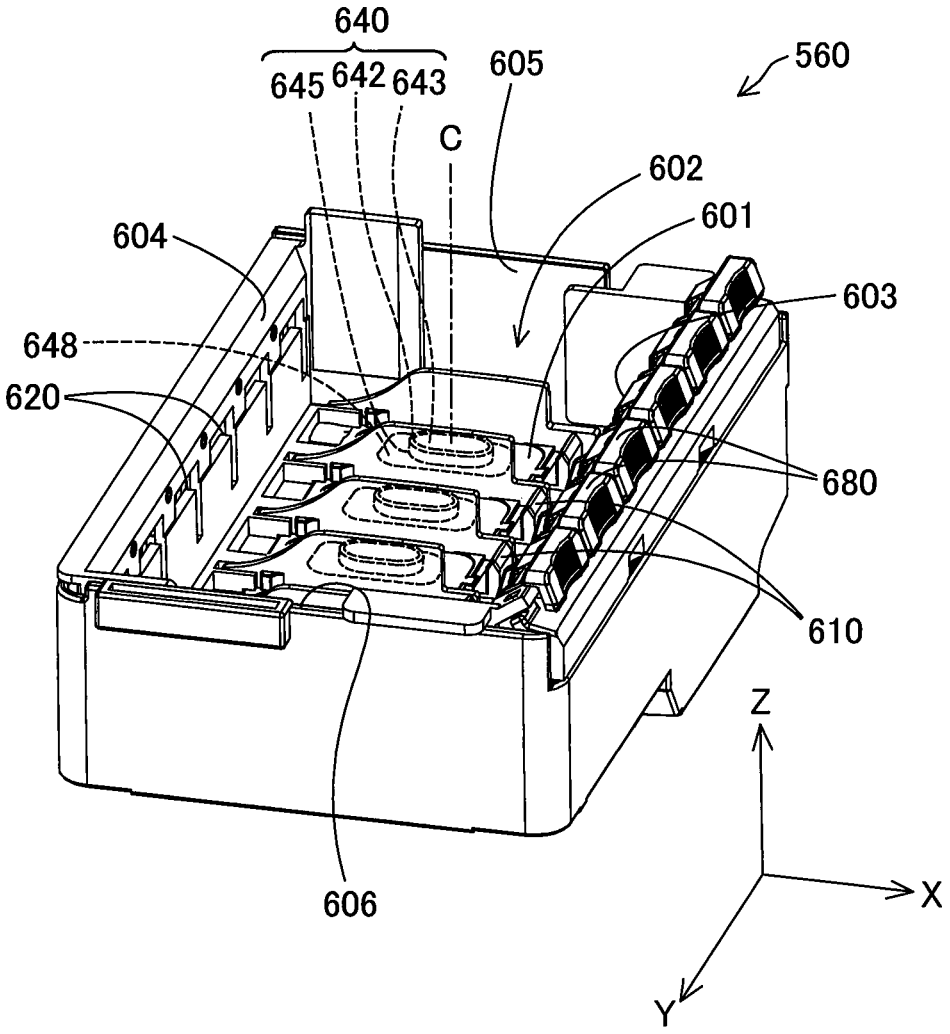
FIG. 3 is a perspective view illustrating the holder.
Figure 4:
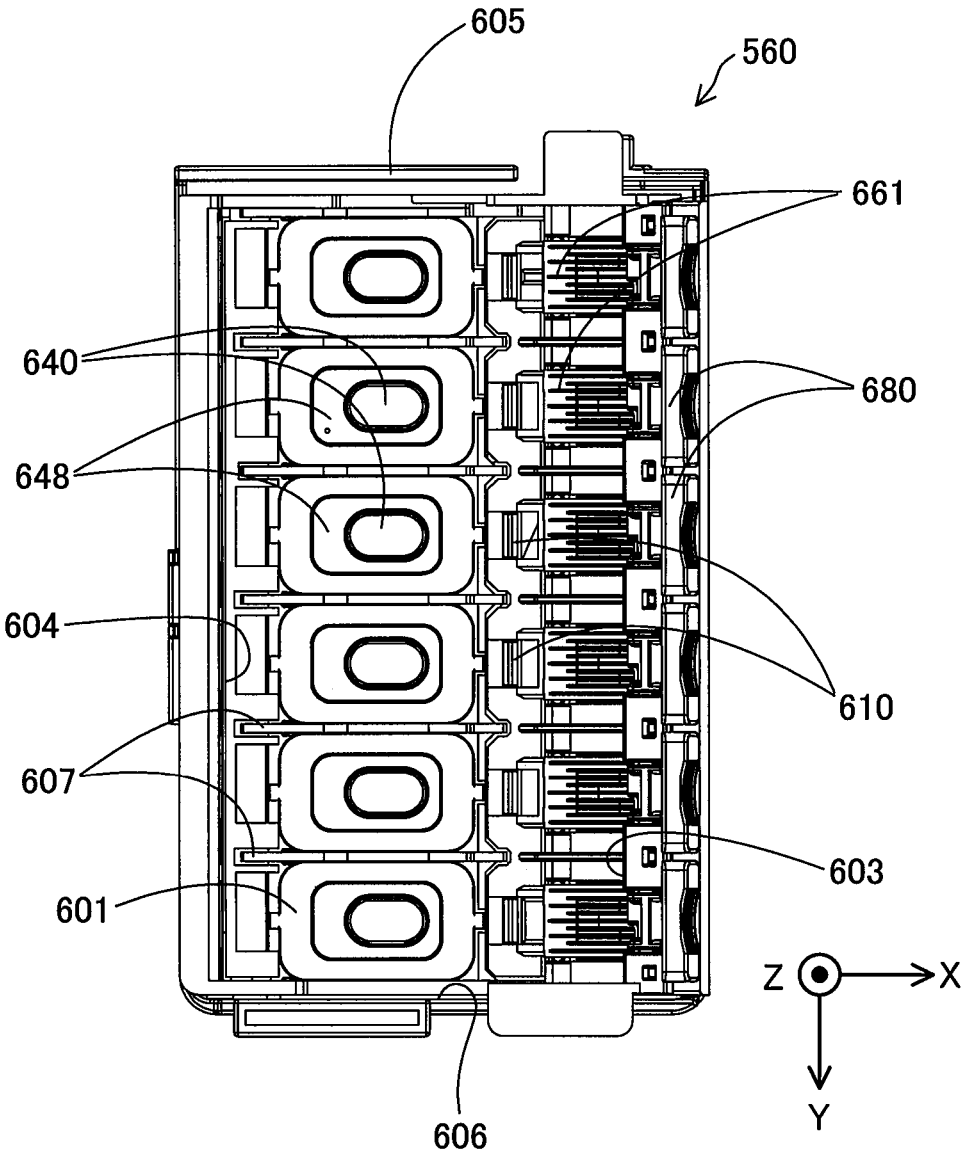
FIG. 4 is a plan view illustrating the holder viewed from a +Z direction side.
Figure 5:
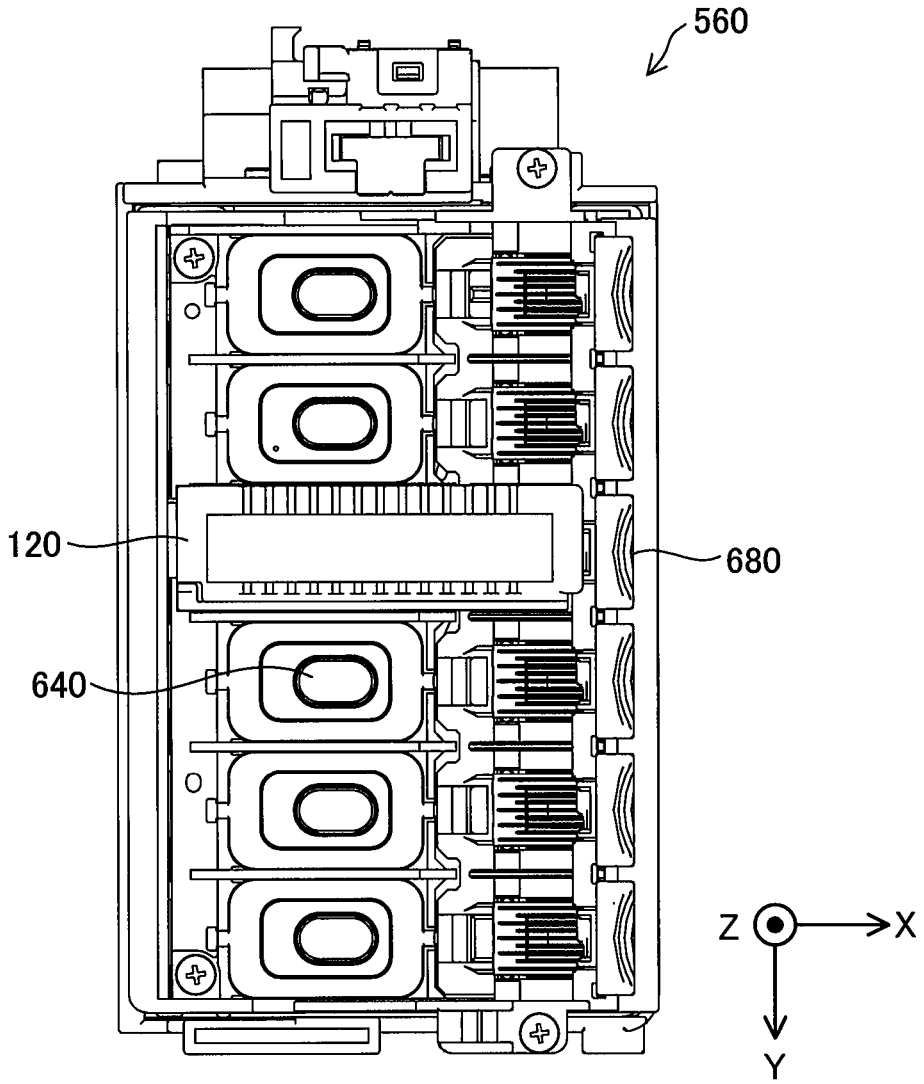
FIG. 5 is a plan view illustrating the holder with one cartridge mounted thereto.

FIG. 2 and FIG. 3 are perspective views illustrating the holder 560, and FIG. 4 is a plan view illustrating the holder 560 viewed from the +Z direction side. FIG. 5 is a plan view illustrating the holder 560 with one cartridge 120 mounted thereto.

The holder 560 includes five wall portions 601, 603, 604, 605 and 606. A recess formed by these five wall portions forms a cartridge chamber 602 (also called "cartridge mounting structure 602"). Hereinafter the wall portion 601 is also called bottom 601. The cartridge chamber 602 is divided by partition walls 607 into a plurality of slots (mounting spaces), each being configured to place each cartridge 120 therein. The partition walls 607 serve as a guide for inserting the cartridges 120 into the slots. Each slot is provided with a liquid introducing portion 640, a sheet member 648, an electrode portion 661, a lever 680, a positioning projection 610 and an apparatus-side restriction structure 620 (shown in FIG. 3). The apparatus-side restriction structurer 620 is a hole formed in a side wall 604 of the holder 560. One side face (+Z direction side face: upper face) of each slot is open, and the cartridge 120 is mounted to and demounted from the holder 560 via this open side face (upper face). The liquid introducing portion 640 is provided to be placed between the two partition walls 607.

The positioning projection 610 is an approximately rectangular parallelepiped member protruded in the +Z direction from the bottom 601. The positioning projection 610 is inserted into a positioning structure (described later) provided in the cartridge 120. The positioning projection 610 has a +X direction side face and a −X direction side face on its leading end portion that are inclined to be closer to each other toward the tip, in order to facilitate insertion into the positioning structure of the cartridge 120.

The cartridge 120 is locked by the lever 680 and the apparatus-side restriction structure 620 and is mounted to the holder 560 in such a state that its liquid supply port (described later) is connected with the liquid introducing portion 640. This state is also called the "state that the cartridge is mounted to the holder 560" or the "mounted state". In the mounted state, a terminal group provided on a circuit board (described later) of the cartridge 120 is electrically connected with the electrode portion 661, so as to allow for transmission of various information between the cartridge 120 and the printer 150.

In the mounted state, the liquid introducing portion 640 (shown in FIG. 3) is connected with the liquid supply port of the cartridge 120 to introduce the liquid contained in the cartridge 120 to the liquid ejection head 540 that communicates with the liquid introducing portion 640. The liquid introducing portion 640 is in an approximately tubular form and includes a leading end portion 642 located on its +Z direction side and a base end portion 645 located on its −Z direction side. The base end portion 645 is provided on the bottom 601. The leading end portion 642 is connected with the liquid supply port of the cartridge 120. The leading end portion 642 is provided with an apparatus-side filter 643. The liquid is flowed from the liquid supply port of the cartridge 120 through the apparatus-side filter 643 into the liquid introducing portion 640. The apparatus-side filter 643 may be made of, for example, a porous member, such as a metal mesh, a metal nonwoven fabric or a resin filter. The liquid introducing portion 640 has a center axis C that is parallel to the Z direction. A direction from the base end portion 645 toward the leading end portion 642 along the center axis C is +Z direction.

The sheet member 648 is provided around the base end portion 645 of the liquid introducing portion 640 to surround the liquid introducing portion 640. The sheet member 648 may be made of, for example, elastic rubber. The sheet member 648 seals the periphery of the liquid supply port of the cartridge 120 in the mounted state. The sheet member 648 accordingly prevents leakage of the liquid from the liquid supply port to the periphery. In the mounted state, the sheet member 648 applies a biasing force including a +Z-axis direction component to the cartridge 120.

Figure 6:
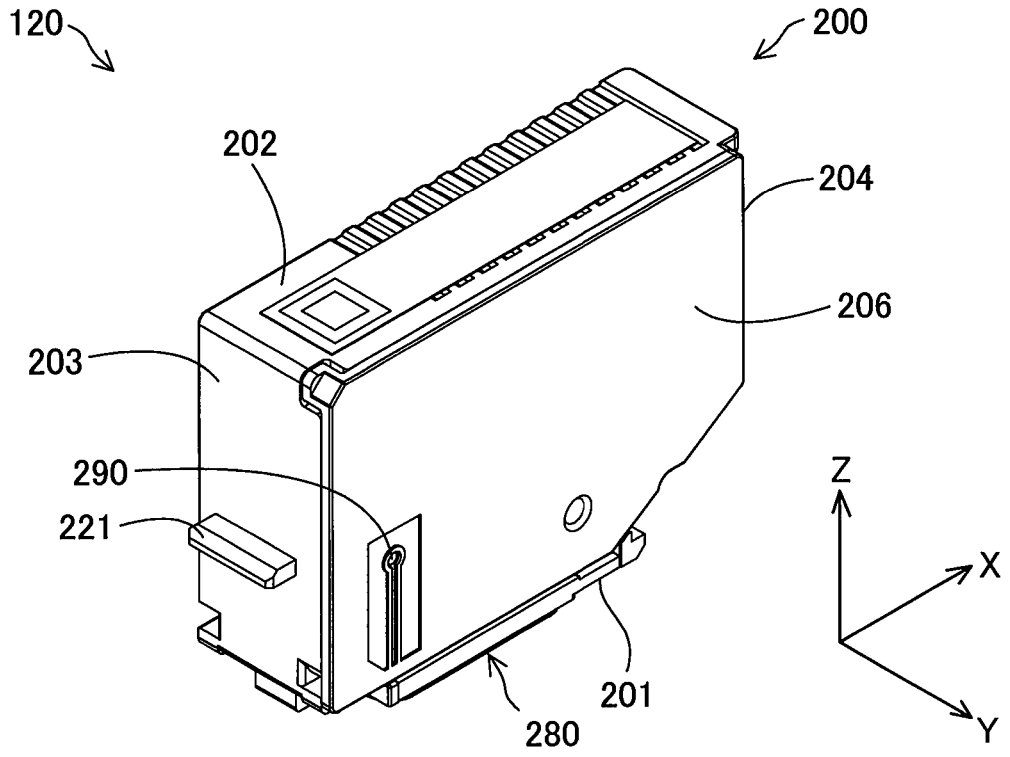
FIG. 6 is a perspective view illustrating the cartridge.
Figure 7:
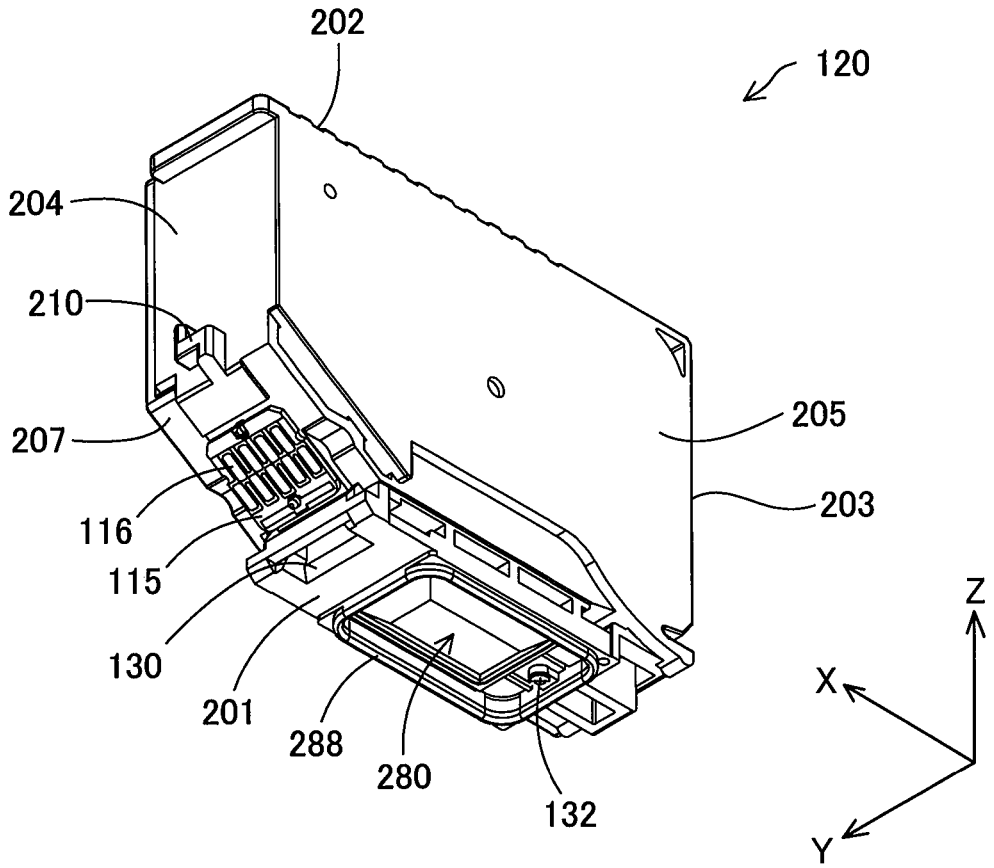
FIG. 7 is a perspective view illustrating the cartridge.
Figure 8:
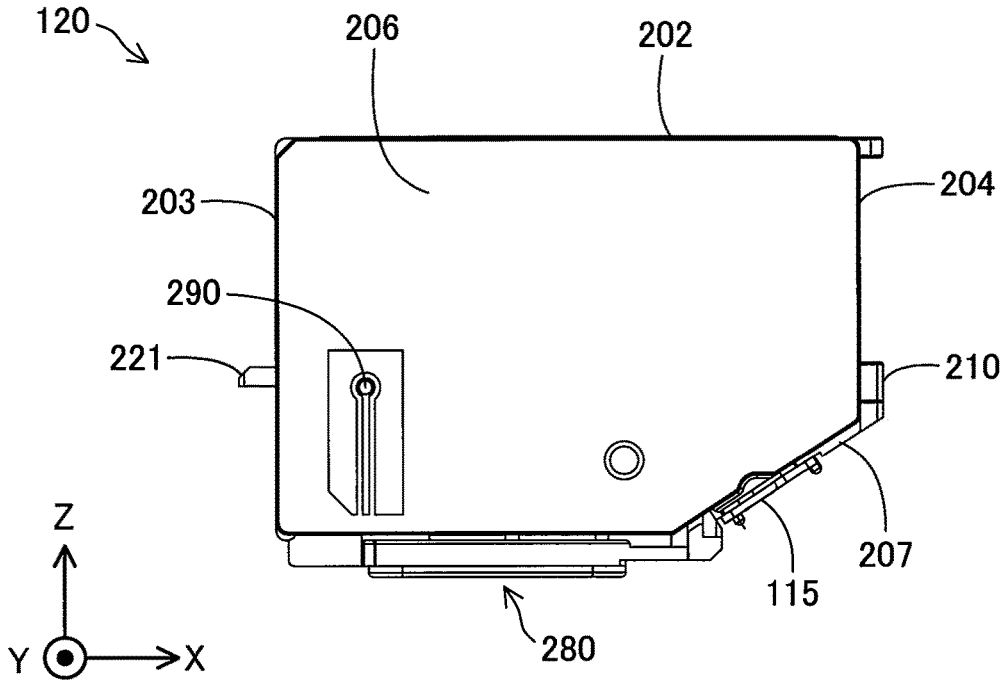
FIG. 8 is a front view illustrating the cartridge.
Figure 9:
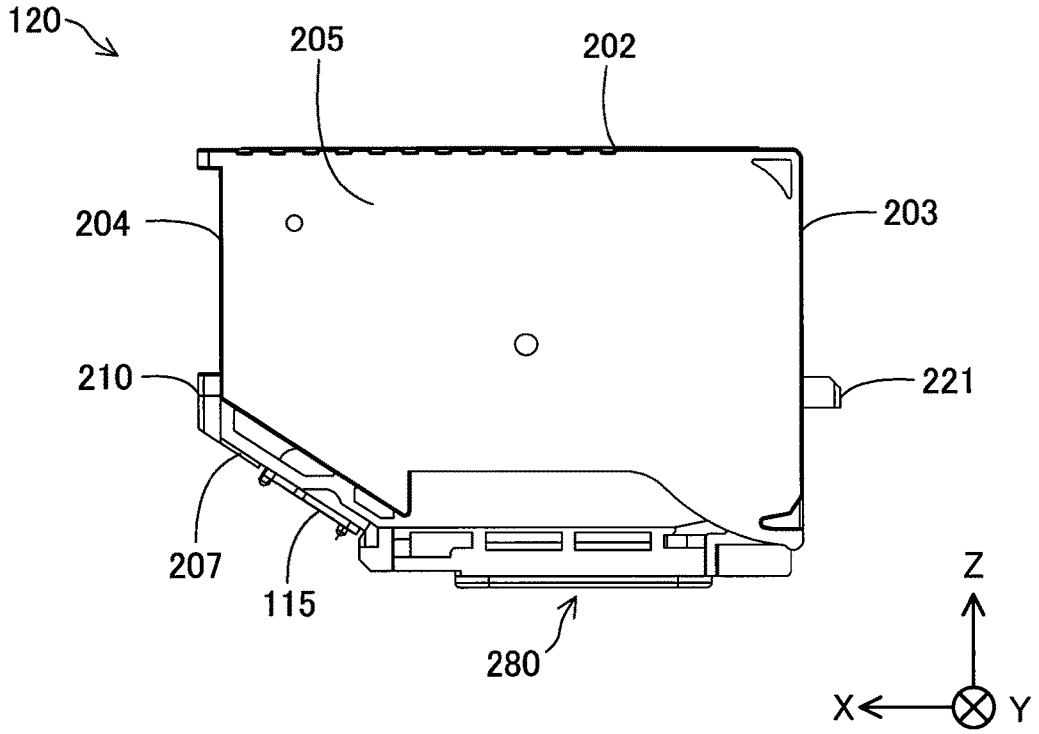
FIG. 9 is a rear view illustrating the cartridge.
Figure 10:
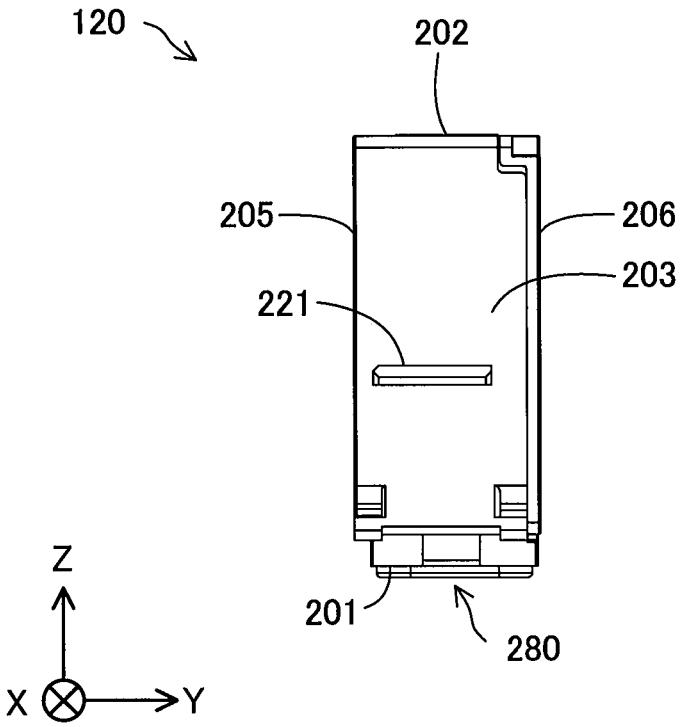
FIG. 10 is a left side view illustrating the cartridge.
Figure 11:
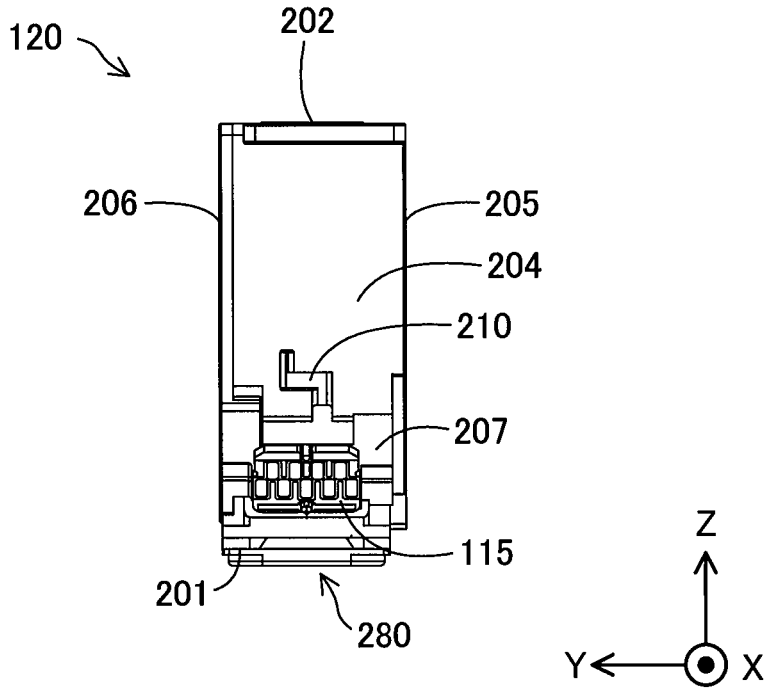
FIG. 11 is a right side view illustrating the cartridge.
Figure 12:
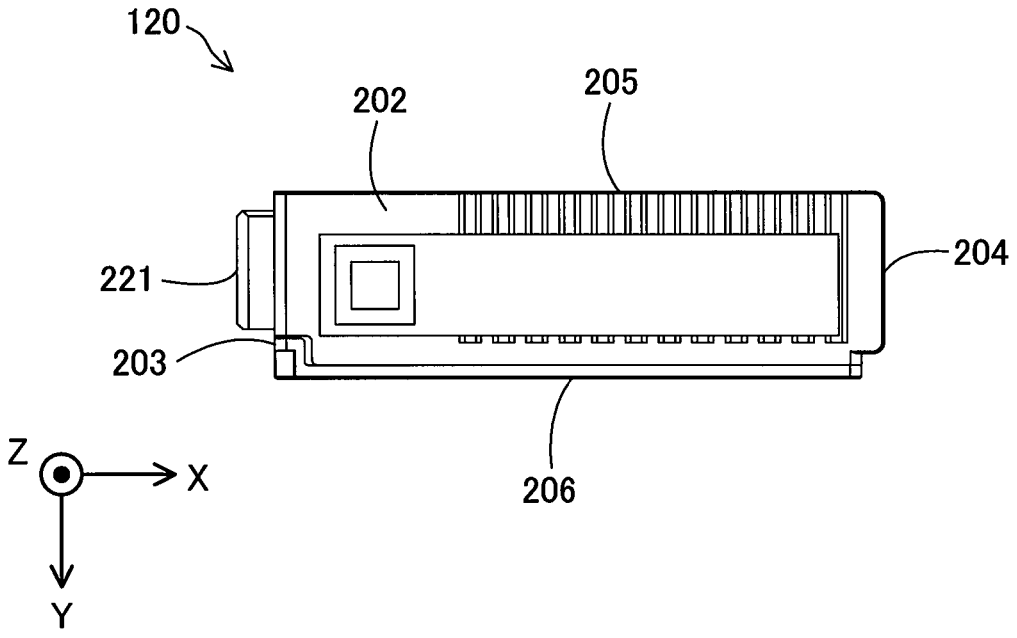
FIG. 12 is a plan view illustrating the cartridge.
Figure 13:
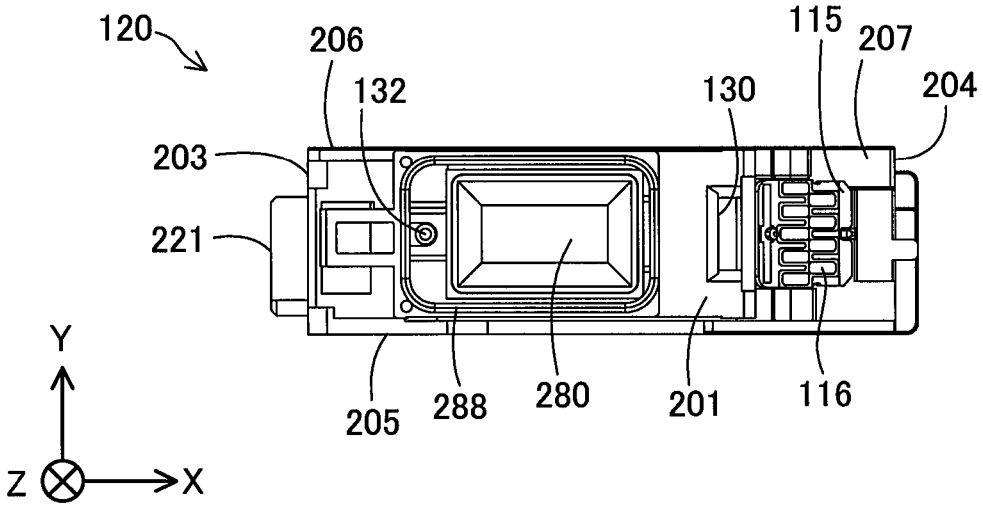
FIG. 13 is a bottom view illustrating the cartridge.

FIGS. 6 and 7 are perspective views illustrating the cartridge 120, and FIGS. 8 to 13 are six view drawings (front view, rear view, left side view, right side view, plan view and bottom view) of the cartridge 120. The cartridge 120 is a semi-sealed type cartridge that intermittently introduces the outside air into the inside of the cartridge 120 with consumption of the liquid.

The cartridge 120 includes seven wall portions 201 to 207. These wall portions constitute an approximately rectangular parallelepiped outer shell 200 of the cartridge 120. The seven wall portions include a first wall portion 201 (bottom wall 201), a second wall portion 202 (upper wall 202), a third wall portion 203 (third side wall 203), a fourth wall portion 204 (fourth side wall 204), a fifth wall portion 205 (first side wall 205), a sixth wall portion 206 (second side wall 206), and a seventh wall portion 207 (inclined wall 207).

In the description below, the state that two wall portions "cross" or "intersect" means any one of the state that two wall portions are joined with each other to cross, the state that an extension of one wall portion intersects with the other wall portion and the state that extensions of the respective wall portions cross. The state that two wall portions are "opposed to each other" includes both the case where no other object is present between two walls and the case where another object is present between two walls.

The respective wall portions 201 to 207 have practically planar outer surfaces. The practically planar state includes both the case where the entire surface is completely flat and the case where the surface partly includes some concavity and convexity. More specifically, the practically planar state includes the case where the surface partly including some concavity and convexity is still regarded as a surface or a wall forming the outer shell 200 of the cartridge 120. The outer shapes of the first wall portion 201 to the seventh wall portion 207 in the plan view (in the state that the respective wall portions are observed from their normal directions) are rectangular, except the fifth wall portion 205 and the sixth wall portion 206. According to this embodiment, the first wall portion 201 to the seventh wall portion 207 may be outer surfaces of an assembly obtained by assembling a plurality of members. According to this embodiment, the first wall portion 201 to the seventh wall portion 207 are plate-like members. According to another embodiment, part of the first wall portion 201 to the seventh wall portion 207 may be a film-like (thin film-like) member or a sheet-like member. The first wall portion 201 to the seventh wall portion 207 may be made of, for example, a synthetic resin such as polyacetal (POM).

The first wall portion 201 (bottom wall) and the second wall portion 202 (upper wall) are wall portions that are parallel to the X axis and the Y axis and are opposed to each other in the Z direction that intersects with the X direction. The first wall portion 201 is located on the −Z direction side, and the second wall portion 202 is located on the +Z direction side. The first wall portion 201 and the second wall portion 202 have such a positional relationship as to intersect with the third wall portion 203, the fourth wall portion 204, the fifth wall portion 205 and the sixth wall portion 206. According to this embodiment, in the mounted state that the cartridge 120 is mounted to the holder 560, the first wall portion 201 forms a bottom face of the cartridge 120, and the second wall portion 202 forms an upper face of the cartridge 120. The first wall portion 201 (shown in FIG. 13) is provided with a liquid supply port 280, an outer circumferential wall 288 and a positioning structure 130. The liquid supply port 280 is connected with the liquid introducing portion 640 (shown in FIG. 4) of the holder 560. The positioning structure 130 is engaged with the positioning projection 610 (shown in FIG. 4) of the holder 560 and thereby serves to position the cartridge 120 in the Y direction. An air hole 132 is formed inside of the outer circumferential wall 288. The air hole 132 is an opening provided to connect a closed space inside of the outer circumferential wall 288 with the outside. In the mounted state, the configuration that the air hole 132 makes the closed space inside of the outer circumferential wall 288 with the outside (ambient air) maintains an approximately constant pressure difference between the closed space and the outside. This accordingly suppresses leakage of the liquid from the liquid supply port 280 with a variation in pressure inside of the closed space.

The third wall portion 203 (third side wall) and the fourth wall portion 204 (fourth side wall) are wall portions that are parallel to the Y axis and the Z axis and are opposed to each other in the X direction. The third wall portion 203 is located on the −X direction side, and the fourth wall portion 204 is located on the +X direction side. The third wall portion 203 is arranged to intersect with the first wall portion 201 and the second wall portion 202. The fourth wall portion 204 is arranged to intersect with the first wall portion 201 and the second wall portion 202 and is opposed to the third wall portion 203. According to this embodiment, in the state that the cartridge 120 is mounted to the carriage 520, the moving direction X of the carriage 520 is along a direction from the third wall portion 203 to the fourth wall portion 204. A first cartridge-side restriction structure 210 of a projection shape is formed on the fourth wall portion 204 (shown in FIG. 11). The first cartridge-side restriction structure 210 is locked by the lever 680 in the mounted state. A second cartridge-side restriction structure 221 of a projection shape is formed on the third wall portion 203 (shown in FIG. 10). The second cartridge-side restriction structure 221 is a projection that is protrude in the −X direction from the third wall portion 203 to be engaged with the apparatus-side restriction structure 620 of the carriage 520 (shown in FIG. 3). The apparatus-side restriction structurer 620 is a hole formed in the side wall 604 of the holder 560. In the mounted state, the second cartridge-side restriction structure 221 is inserted and locked in the apparatus-side restriction structure 620. More specifically, in the mounted state, the cartridge 120 is locked on the respective sides in the X direction by the lever 680 and the apparatus-side restriction structure 620 of the holder 560, so as to be fixed to the holder 560.

The fifth wall portion 205 (first side wall) and the sixth wall portion 206 (second side wall) are wall portions that are parallel to the X axis and the Z axis and are opposed to each other in the Y direction that intersect with the X axis and the Z axis. The fifth wall portion 205 is arranged to intersect with the first wall portion 201, the second wall portion 202, the third wall portion 203 and the fourth wall portion 204. The sixth wall portion 206 is arranged to intersect with the first wall portion 201, the second wall portion 202, the third wall portion 203 and the fourth wall portion 204 and is opposed to the fifth wall portion 205. An opening 290 is formed in the sixth wall portion 206 (shown in FIG. 8) to introduce the air into the cartridge 120.

The seventh wall portion 207 (shown in FIG. 7) is an inclined wall provided to connect the first wall portion 201 with the fourth wall portion 204. The seventh wall portion 207 is arranged to intersect with the fifth wall portion 205 and the sixth wall portion 206 and is located between the first wall portion 201 and the fourth wall portion 204. Contact portions 116 are formed on the seventh wall portion 207 to come into contact with the electrode portion 661 of the printer 150. According to this embodiment, these contact portions 116 are formed on a substrate 115 provided on the seventh wall portion 207. In other words, the substrate 115 has a plurality of the contact portions 116 that come into contact with the electrode portion 661 provided on the holder 560 in the mounted state. More specifically, the contact portions 116 denote contact areas of electrode terminals provided on the surface of the substrate 115, such as to come into contact with the electrode portion 661. According to this embodiment, the plurality of contact portions 116 (shown in FIG. 13) are arranged to form two arrays that are arrayed along the Y-axis direction at predetermined intervals in the X direction, when being viewed from the −Z direction. A storage device (described later) is provided on a rear face of the substrate 115 to store various information regarding the cartridge 120. For example, information indicating the remaining amount of ink and the color of ink is stored in this storage device. When the electrode portion 661 provided on the holder 560 comes into contact with the contact portions 116, the controller 510 provided in the printer 150 reads various information from the storage device provided in the cartridge 120 via the flexible cable 517.

Figure 14:
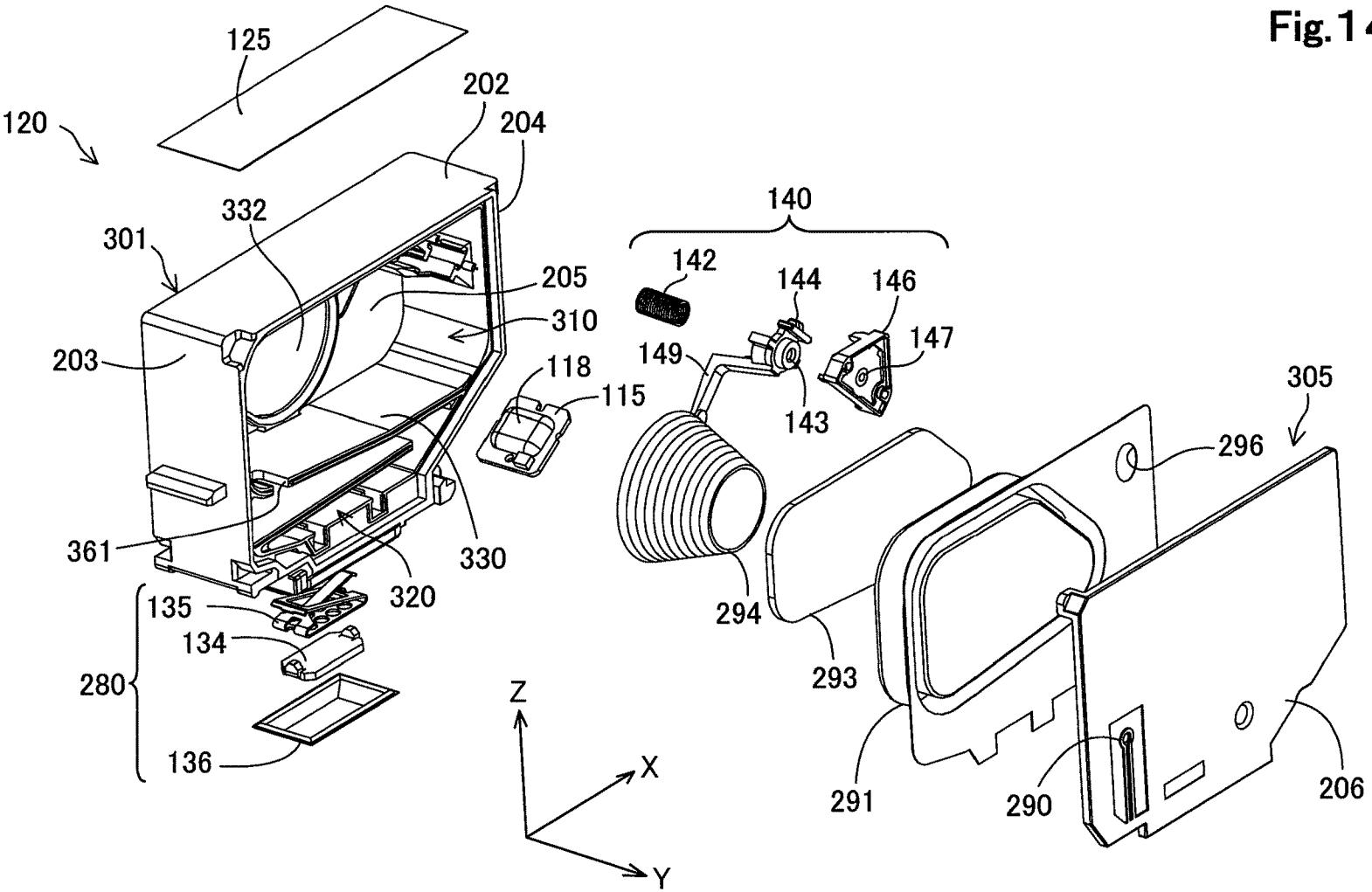
FIG. 14 is an exploded perspective view illustrating the cartridge.

FIG. 14 is an exploded perspective view illustrating the cartridge 120. The cartridge 120 includes a main body member 301 and a cover member 305 on the front face side. The main body member 301 is configured as a box-like member in an approximately rectangular parallelepiped shape having an opening on its +Y direction side. The main body member 301 forms the first wall portion 201, the second wall portion 202, the third wall portion 203, the fourth wall portion 204 and the fifth wall portion 205. The cover member 305, on the other hand, forms the sixth wall portion 206. The main body member 301 includes a partition wall 330 placed inside thereof. The partition wall 330 is arranged to part a liquid containing space inside of the main body member 301 into a first chamber 310 on the +Z direction side that is the upper wall 202-side in the Z direction and a second chamber 320 on the −Z direction side that is the bottom wall 201-side in the Z direction. The first chamber 310 is also called "main chamber", and the second chamber 320 is also called "sub-chamber". In the non-use state of the cartridge 120, ink is contained in the first chamber 310 and in the second chamber 320. The first chamber 310 and the second chamber 320 communicate with each other via a connecting hole 361 provided for communication between the first chamber 310 and the second chamber 320. The connecting hole 361 is provided in the partition wall 330. The second chamber 320 is connected with the liquid supply port 280. The first chamber 310 is connected with the liquid supply port 280 via the connecting hole 361 and the second chamber 320. According to this embodiment, the second chamber 320 has a larger inner space volume than an inner space volume of the first chamber 310. According to another embodiment, the inner space volume of the second chamber 320 may be smaller than the inner space volume of the first chamber 310.

The cartridge 120 of the embodiment further includes a sheet member 291 having flexibility, as a member that, in cooperation with the main body member 301, forms a liquid containing space. The sheet member 291 is a thin film having liquid impermeability, air tightness and flexibility. The sheet member 291 is joined with the main body member 301 by bonding or welding and, in combination with the main body member 301, define and form the first chamber 310 and the second chamber 320. The sheet member 291 is formed in such dimensions as to cover the first chamber 310, the second chamber 320 and various flow paths formed below the second chamber 320. As described above, part of the outer walls of the first chamber 310 and the second chamber 320 is formed by the sheet member 291.

The cover member 305 is attached to the main body member 301 such as to cover the sheet member 291. The main body member 301 and the cover member 305 are made of a synthetic resin, such as polypropylene. The sheet member 291 is made of a synthetic resin, such as a composite material containing nylon and polypropylene.

A pressure receiving plate 293 as a plate-like member is placed inside of the first chamber 310. One surface of the pressure receiving plate 293 is in contact with the sheet member 291. A coil spring 294 as a biasing member is placed between the other surface (−Y direction side surface) of the pressure receiving plate 293 and the fifth wall portion 205. A recess 332 is formed at the center of an inner surface of the fifth wall portion 205 to receive the coil spring 294. The coil spring 294 biases the pressure receiving plate 293 from the fifth wall portion 205 toward the sixth wall portion 206. More specifically, the coil spring 294 biases the sheet member 291 via the pressure receiving plate 293 in a direction of expanding the volume of the first chamber 310. The internal pressure of the first chamber 310 is maintained at a pressure (negative pressure) lower than the atmospheric pressure by the biasing force of this coil spring 294. The coil spring 294 used has a truncated cone outer shape but may have a cylindrical outer shape.

A breather valve 140 is further placed inside of the first chamber 310 to introduce the air into the first chamber 310. The breather valve 140 includes a valve seat 146, a valve member 144 and a coil spring 142. The valve member 144 is pressed against the valve seat 146 by the coil spring 142 to close an air introducing hole 147 that is a through hole formed in the valve seat 146. The valve member 144 includes a valve element portion 143 provided to open and close the air introducing hole 147 and a lever portion 149 provided to abut on the pressure receiving plate 293 and thereby make the valve element portion 143 movable. The valve seat 146 is placed in a corner of the main body member 301 where the second wall portion 202 intersects with the fourth wall portion 204 and is attached to the main body member 301. The valve seat 146 includes a recess, and the sheet member 291 is airtightly applied to an end face that forms an opening of the recess. The recess of the valve seat 146 communicates with a through hole 296 of the sheet member 291. The air introducing hole 147 is formed in a bottom of the recess of the valve seat 146 to be pierced to the rear side of the valve seat 146. The air introducing hole 147 communicates with the first chamber 310. In other words, the air introducing hole 147 is provided in the first chamber 310. The air introducing hole 147 is configured to introduce the air from outside of the first chamber 310 to inside of the first chamber 310. The valve element portion 143 of the valve member 144 is pressed against the valve seat 146 by the coil spring 142 to close the air introducing hole 147. The lever portion 149 of the valve member 144 is pressed by the pressure receiving plate 293 when the pressure receiving plate 293 moves in the −Y direction. As described later, when the lever portion 149 is pressed by the pressure receiving plate 293, the state of the valve element portion 143 and the valve seat 146 changes from a valve closed position to a valve open position.

A flat spring 135, a liquid-permeable porous member 134 (for example, resin foam) and a cartridge-side filter 136 are sequentially fit in the liquid supply port 280 provided in the bottom face of the main body member 301. The cartridge-side filter 136 comes into contact with the liquid introducing portion 640 (shown in FIG. 4) of the holder 560 to supply the liquid to the liquid introducing portion 640.

The substrate 115 provided with a storage device 118 is fixed to the seventh wall portion 207 of the main body member 301. A label 125 may be applied on an outer surface of the second wall portion 202 of the main body member 301. For example, the manufacturer and the model number of the cartridge 120 are shown on the label 125. The label 125 may be applied at any position. For example, the label 125 may be applied on any one wall portion among the second wall portion 202, the third wall portion 203, the fourth wall portion 204, the fifth wall portion 205 and the sixth wall portion 206 or may be applied across two or more wall portions.

Figure 15:
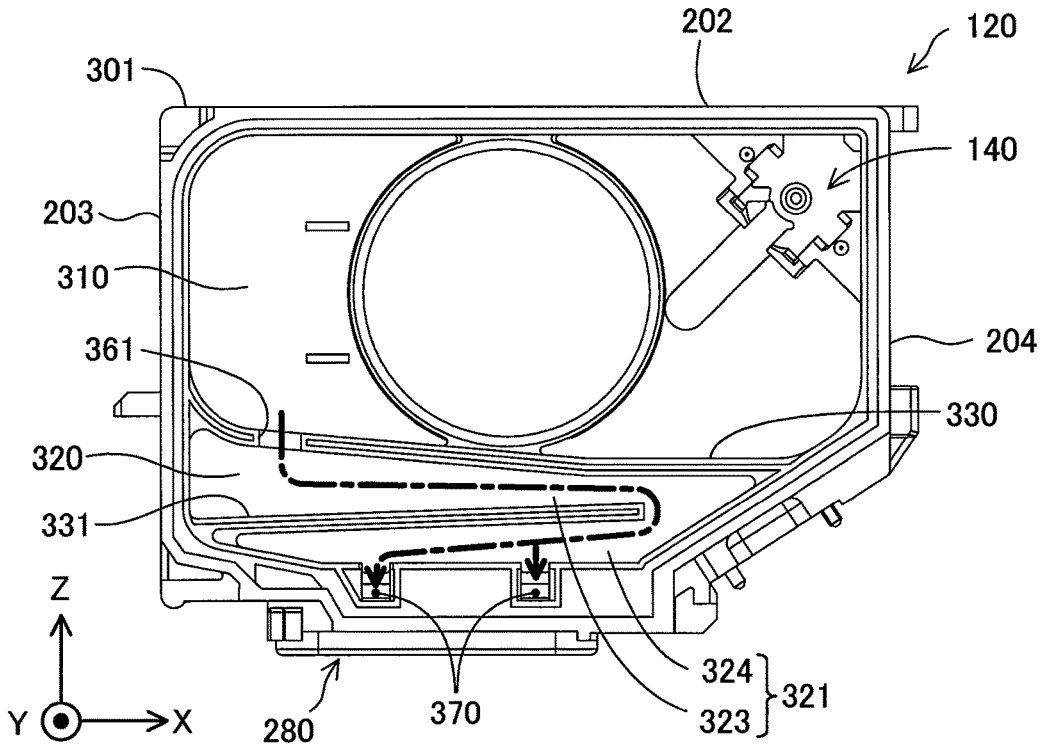
FIG. 15 is a front view illustrating a main body member.

FIG. 15 is a front view illustrating the main body member 301. A thick one-dot chain line arrow indicates the flow route of ink in FIG. 15. The first chamber 310 is formed on the +Z direction side of the partition wall 330 in the main body member 301. FIG. 15 illustrates the state that the breather valve 140 described above with reference to FIG. 14 is placed inside of the first chamber 310. The first chamber 310 is a space of an approximately rectangular sectional shape surrounded by an inner surface of the second wall portion 202, an inner surface of the third wall portion 203, an inner surface of the fourth wall portion 204, an inner surface of the fifth wall portion 205 and an upper surface of the partition wall 330. The +Y direction side of the first chamber 310 is sealed by the sheet member 291 (shown in FIG. 14). A connecting hole 361 is provided at a position nearer to the third wall portion 203 than the fourth wall portion 204 in the bottom of the first chamber 310 to connect the first chamber 310 with the second chamber 320. This connecting hole 361 is an opening provided in the partition wall 330. Ink moves from the first chamber 310 through the connecting hole 361 to the second chamber 320 that is located below (on the −Z direction side of) the first chamber 310. According to the embodiment, the connecting hole 361 has such dimensions and shape that allow for gas-liquid exchange between the first chamber 310 and the second chamber 320. The connecting hole 361 is preferably a quadrilateral having a dimension in the X direction of not less than 2 mm and not greater than 5 mm and a dimension in the Y direction of not less than 2 mm and not greater than 5 mm. The connecting hole 361 of smaller than 2 mm×2 mm is likely to make gas-liquid exchange difficult. The connecting hole 361 of larger than 5 mm×5 mm is, on the other hand, likely to cause bubbles in the first chamber 310 to affect the second chamber 320. As the shape of the connecting hole 361, an angular shape such as a quadrilateral shape is more advantageous for gas-liquid exchange than a non-angular shape such as a circular shape, an elliptical shape or a track-like shape.

The second chamber 320 includes a return flow path 321 formed by turning back the flow path along the X direction. This return flow path 321 causes a plurality of flow paths along the X direction to be arrayed in the Z direction in the second chamber 320. A width along the X direction of the return flow path 321 is greater than a width along the X direction of the liquid supply port 280. The ink in the first chamber 310 is flowed from the connecting hole 361 through the return flow path 321 to the liquid supply port 280. According to this embodiment, the return flow path 321 includes a first flow path 323 in which ink flows from the third wall portion 203-side toward the fourth wall portion 204-side and a second flow path 324 in which ink flows from the fourth wall portion 204-side toward the third wall portion 203-side. The first flow path 323 communicates with the first chamber 310 via the connecting hole 361. The second flow path 324 is located below (on the −Z direction side of) the first flow path 323. A width along the Z direction of the first flow path 323 and the second flow path 324, i.e., the height of the flow path, is 2 to 3 mm. The first flow path 323 and the second flow path 324 are connected with each other in the vertical direction (in the Z direction) at respective +X direction side ends.

In the description below, the first chamber 310-side of the return flow path 321 is called upstream side, and the liquid supply port 280-side of the return flow path 321 is called downstream side. According to this embodiment, a wall 331 (hereinafter called middle wall 331) that forms an upper surface of the second flow path 324, which is the most downstream flow path of the return flow path 321, includes a portion that is inclined to the +Z direction side from the downstream side toward the upstream side. The middle wall 331 may be entirely inclined or may include a non-inclined part. The partition wall 330 forms an upper surface of the first flow path 323, which is the most upstream flow path of the return flow path 321, and includes a portion that is inclined to the +Z direction side from the downstream side toward the upstream side. The partition wall 330 may be entirely inclined or may include a non-inclined part. As described above, according to this embodiment, the partition wall 330 and the middle wall 331 have opposite inclinations. Accordingly, an extension along the inclination of the downstream side of the inclined portion of the partition wall 330 and an extension along the inclination of the upstream side of the inclined portion of the middle wall 331 intersect with each other.

Two supply port communicating paths 370 that communicate with the liquid supply port 280 are formed in a bottom of the second chamber 320. The configuration that two supply port communicating paths 370 are provided for one liquid supply port 280 accelerates the gas-liquid exchange phenomenon that makes the liquid flow out from one of the two supply port communicating paths 370, while making the gas flow into the cartridge 120 from the other of the two supply port communicating paths 370, even when the liquid flows from the liquid supply port 280 into the liquid introducing portion 640 in the state that the gas is present in a connection between the liquid supply port 280 and the liquid introducing portion 640 (shown in FIG. 4). This configuration thus enables the liquid to be supplied to the liquid introducing portion 640 without causing air bubbles to be excessively flowed out to the liquid introducing portion 640. According to another embodiment, only one supply port communicating path may be provided for one liquid supply port 280.

As shown in FIG. 15, the ink in the first chamber 310 is flowed from the connecting hole 361 through the return flow path 321 to the liquid supply port 280. More specifically, the ink in the first chamber 310 first flows through the connecting hole 361 provided in the bottom of the first chamber 310 into the return flow path 321 of the second chamber 320, subsequently flows through the first flow path 323 and the second flow path 324 of the return flow path 321 and then flows through the supply port communicating path 370 to the liquid supply port 280. The ink then flows from the liquid supply port 280 and reaches the liquid introducing portion 640 provided in the holder 560 (shown in FIG. 4).

Figure 16:
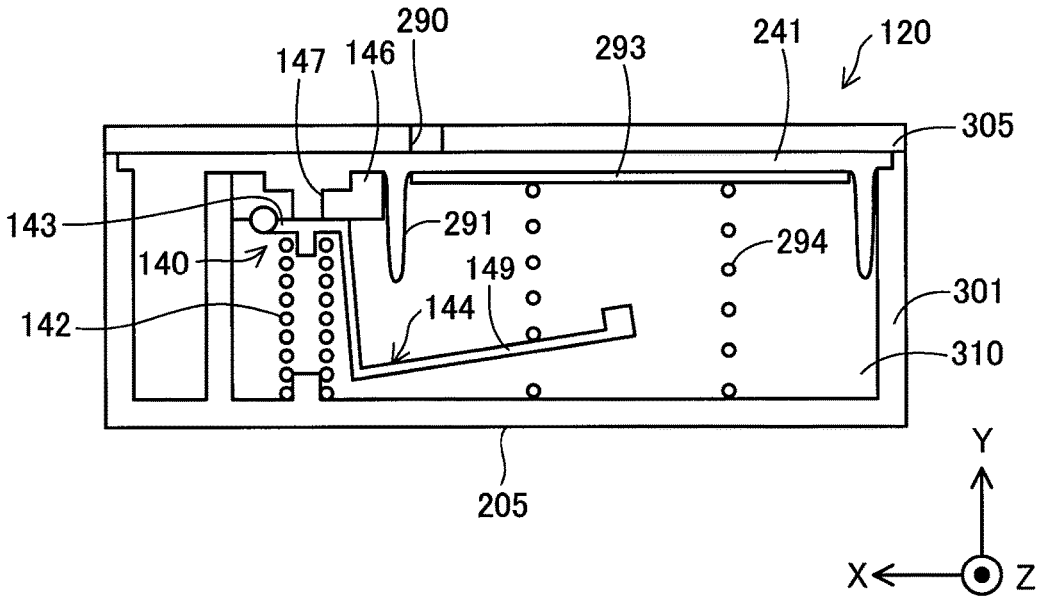
FIG. 16 is a diagram illustrating an operation of a breather valve.
Figure 17:
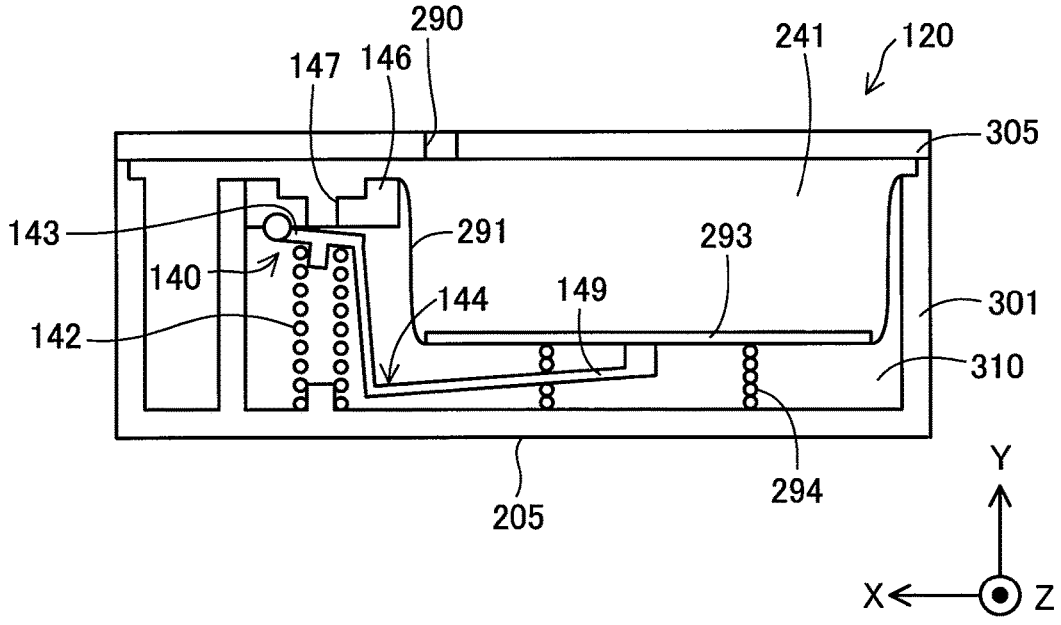
FIG. 17 is a diagram illustrating the operation of the breather valve.
Figure 18:
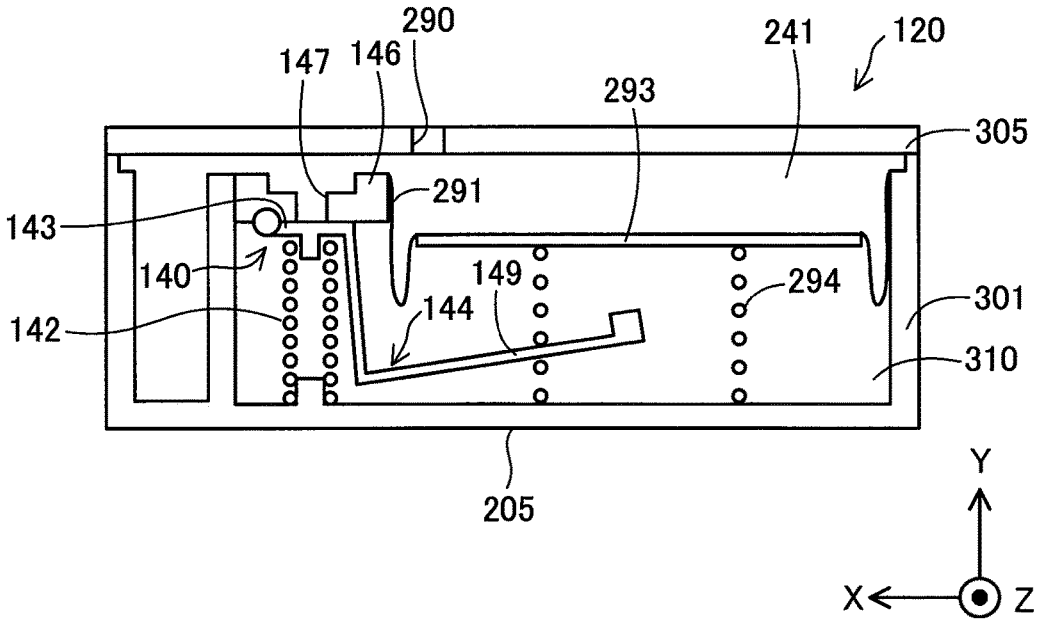
FIG. 18 is a diagram illustrating the operation of the breather valve.

FIGS. 16 to 18 are diagrams illustrating an operation of the breather valve 140 provided in the first chamber 310 of the cartridge 120. The cover member 305 has the opening 290. The first chamber 310 is defined by the main body member 301 and the sheet member 291. An air chamber 241 is formed between the cover member 305 and the sheet member 291. The air chamber 241 communicates with the outside air via the opening 290 provided in the cover member 305. The air hole 132 (shown in FIG. 13) provided in the bottom wall 201 of the cartridge 120 also communicates with the air chamber 241. The pressure receiving plate 293 and the coil spring 294 are placed inside of the sheet member 291. The coil spring 294 biases the pressure receiving plate 293 and the sheet member 291 in a direction of expanding the volume of the first chamber 310. The internal pressure of the first chamber 310 is maintained at a pressure (negative pressure) lower than the atmospheric pressure by the biasing force of this coil spring 294.

The air is introduced into the first chamber 310 via the opening 290, the air chamber 241 and the air introducing hole 147 at a predetermined timing. The air introducing hole 147 is a connecting hole configured to connect the first chamber 310 with the air chamber 241. Introducing the air from the air introducing hole 147 provides the good pressure condition in the first chamber 310. The breather valve 140 is a valve mechanism provided to open and close this air introducing hole 147. The breather valve 140 includes the valve seat 146, the valve member 144 and the coil spring 142. The valve member 144 is pressed against the valve seat 146 by the coil spring 142 to close the air introducing hole 147 that is a through hole formed in the valve seat 146. The valve member 144 includes the valve element portion 143 provided to open and close the air introducing hole 147 and the lever portion 149 provided to abut on the pressure receiving plate 293 and thereby make the valve element portion 143 movable.

In the initial stage (non-use state) of the cartridge 120, the first chamber 310 is filled with ink. In this state, the pressure receiving plate 293 is located at a position nearest to the cover member 305 as shown in FIG. 16. When the pressure receiving plate 293 comes closer to the fifth wall portion 205 with consumption of ink in the first chamber 310, the pressure receiving plate 293 presses the lever portion 149 toward the fifth wall portion 205 as shown in FIG. 17. This causes the valve element portion 143 to be separated from the air introducing hole 147 and thereby sets the valve member 144 in the valve open position. The outside air accordingly flows through the opening 290, the air chamber 241 and the air introducing hole 147 into the first chamber 310. The volume of the first chamber 310 is increased by the introduced amount of the air as shown in FIG. 18. Simultaneously, the internal pressure of the first chamber 310 comes closer to the atmospheric pressure with reducing the negative pressure. When a certain amount of the air is introduced into the first chamber 310, the pressure receiving plate 293 is separated from the lever portion 149. This causes the valve element portion 143 to close the air introducing hole 147 again and thereby sets the valve member 144 in the valve closed position. As described above, when the negative pressure in the first chamber 310 increases with consumption of ink, the valve member 144 is provisionally set in the valve open position, so as to maintain the internal pressure of the first chamber 310 in an appropriate pressure range. This configuration accordingly suppresses, for example, failed supply of the liquid from the liquid supply port 280 due to an excessive increase of the negative pressure in the first chamber 310.

The breather valve 140 may be omitted in the cartridge 120. In this case, the opening 290 may be provided not in the cover member 305 but in the upper wall 202 (shown in FIG. 15) to directly introduce the air from the opening 290 into the first chamber 310. Furthermore, a configuration that does not introduce the air into the first chamber 310 with omission of the opening 290 may also be employable.

In the cartridge 120 of this embodiment described above, the first chamber 310 and the second chamber 320 are parted from each other by the partition wall 330 and are connected with each other via only the connecting hole 361. This configuration suppresses the air bubbles from entering the second chamber 320 even when ink undulates to generate air bubbles in the first chamber 310 accompanied with the reciprocating motion of the carriage 520 or the like. According to the embodiment, the second chamber 320 includes the return flow path 321, which is turned back along the X direction that is the moving direction of the carriage 520. This restricts the height of the flow path serving as the return flow path 321 and results in suppressing undulation of ink in the second chamber 320. Accordingly, this configuration suppresses ink from undulating to generate air bubbles in the second chamber 320. Additionally, according to the embodiment, ink in the first chamber 310 is introduced through the return flow path 321 to the liquid supply port 280. This configuration increases a time period until ink flowing out of the first chamber 310 reaches the liquid supply port 280. Even when air bubbles are mixed in the ink that flows from the first chamber 310 into the second chamber 320, this configuration increases the possibility that air bubbles naturally disappear before ink reaches the liquid supply port 280 and also increases the possibility that air bubbles are joined together to float to the first chamber 310. Accordingly, the configuration of the cartridge 120 of the embodiment reduces the possibility that air bubbles are mixed in the ink that is supplied from the cartridge 120 to the printer 150.

According to the embodiment, the return flow path 321 includes the first flow path 323 in which the liquid flows from the third side wall 203-side toward the fourth side wall 204-side and the second flow path 324 in which the liquid flows from the fourth side wall 204-side toward the third side wall 203-side. This configuration increases the flow path length of the return flow path 321.

According to the embodiment, the first chamber 310 is provided with the air introducing hole 147 that is configured to introduce the air from outside of the first chamber 310 into the first chamber 310. This configuration provides the good pressure condition in the first chamber 310.

According to the embodiment, the middle wall 331 that forms the upper surface of the most downstream side flow path (second flow path 324) of the return flow path 321 includes the portion that is inclined to the +Z direction side from the downstream side toward the upstream side. This configuration enables the air bubbles in the second chamber 320 to be moved to the upstream side by using the buoyance of the air bubbles.

According to the embodiment, the partition wall 330 forms the upper surface of the most upstream side flow path (first flow path 323) of the return flow path 321 and includes the portion that is inclined to the +Z direction side from the downstream side toward the upstream side. This configuration enables the air bubbles in the second chamber 320 to be moved to the upstream side by using the buoyance of the air bubbles.

According to the embodiment, the connecting hole 361 has such dimensions and shape that allow for gas-liquid exchange between the first chamber 310 and the second chamber 320. This configuration enables the air bubbles in the second chamber 320 to be moved to the first chamber 310.

According to the embodiment, the inner space volume of the second chamber 320 is larger than the inner space volume of the first chamber 310. This configuration increases a time period until air bubbles in the second chamber 320 are moved to the liquid supply port 280. This increases the possibility that the air bubbles naturally disappear and increases the possibility that the air bubbles are joined together to be bigger and to be discharged toward the first chamber 310.

B. Second Embodiment

Figure 19:
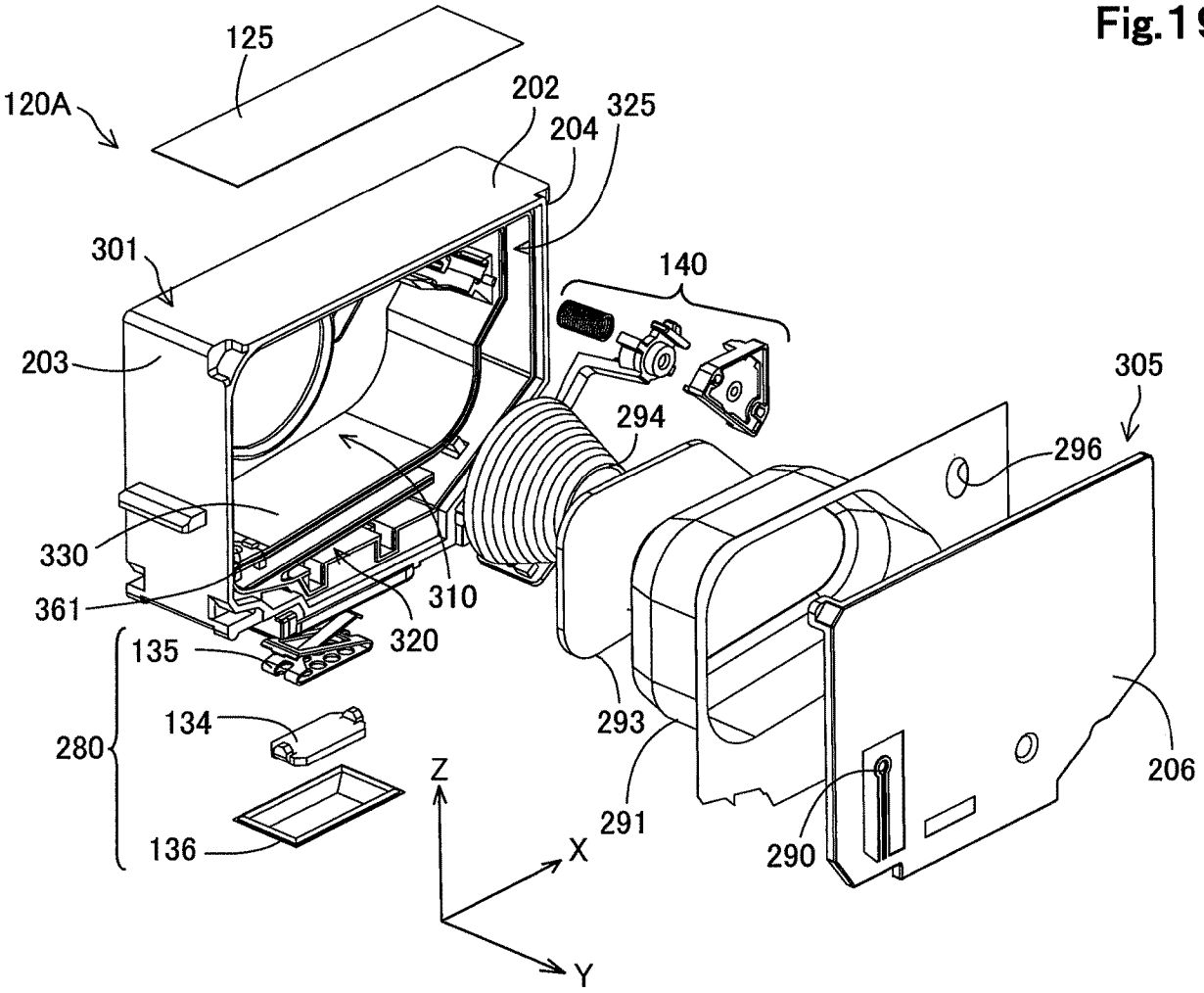
FIG. 19 is an exploded perspective view illustrating a cartridge according to a second embodiment.
Figure 20:
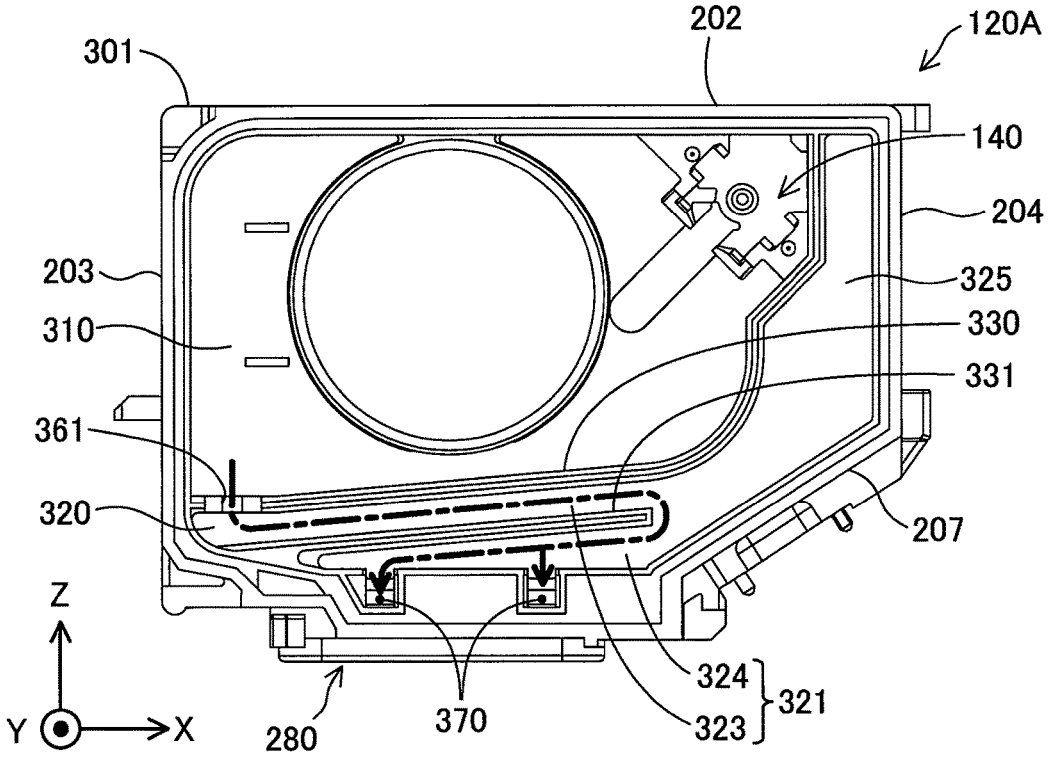
FIG. 20 is a front view illustrating a main body member according to the second embodiment.

FIG. 19 is an exploded perspective view illustrating a cartridge 120A according to a second embodiment. FIG. 20 is a front view illustrating a main body member 301 according to the second embodiment. The cartridge 120A of the second embodiment differs from the cartridge 120 of the first embodiment by the configuration of a second chamber 320 in the main body member 301 but otherwise has a similar configuration to that of the cartridge 120 of the first embodiment. In the respective embodiments described below, members that have like functions to those of the first embodiment are expressed by the like reference signs to those of the first embodiment.

Like the first embodiment, the second chamber 320 of the second embodiment includes a return flow path 321 that is turned back along the X direction. According to this embodiment, the return flow path 321 includes a first flow path 323 in which ink flows from the third wall portion 203-side toward the fourth wall portion 204-side and a second flow path 324 in which ink flows from the fourth wall portion 204-side toward the third wall portion 203-side. The first flow path 323 communicates with the first chamber 310 via the connecting hole 361. The second flow path 324 is located below (on the −Z direction side of) the first flow path 323. A width along the Z direction of the first flow path 323 and the second flow path 324 is 2 to 3 mm. The first flow path 323 and the second flow path 324 are connected with each other in the vertical direction (in the Z direction) at respective +X direction side ends.

According to this embodiment, the second chamber 320 includes a space that is located on the +Z direction side of the return flow path 321 and that serves to accumulate air bubbles therein. In the description below, this space is called air bubble storage portion 325. The air bubble storage portion 325 is connected with the return flow path 321 in the middle of the return flow path 321. The air bubble storage portion 325 is preferably connected with the return flow path 321 at a position that is far from an upstream side end and a downstream side end of the return flow path 321. According to the embodiment, the air bubble storage portion 325 is connected at a turn where the first flow path 323 and the second flow path 324 are connected with each other.

According to the embodiment, a middle wall 331 that forms an upper surface of the second flow path 324, which is the most downstream flow path of the return flow path 321, includes a portion that is inclined to the +Z direction side from the downstream side toward the upstream side. The middle wall 331 may be entirely inclined or may include a non-inclined part. A partition wall 330 forms an upper surface of the first flow path 323, which is the most upstream flow path of the return flow path 321, and includes a portion that is inclined to the −Z direction side from the downstream side toward the upstream side. According to this embodiment, the partition wall 330 and the middle wall 331 are arranged to be approximately parallel to each other as shown in FIG. 20. The partition wall 330 may be entirely inclined or may include a non-inclined part. According to the embodiment, the partition wall 330 is extended in the +Z direction at a +X direction end of the return flow path 321 and is connected with the second wall portion 202 to form part of the wall of the air bubble storage portion 325. Accordingly, the air bubble storage portion 325 is defined by the partition wall 330, the second wall portion 202, the fourth wall portion 204 and the seventh wall portion 207 in the main body member 301. A +Y direction side of the air bubble storage portion 325 is sealed by a sheet member 291 (shown in FIG. 19).

A thick one-dot chain line arrow indicates the flow route of ink in FIG. 20. Ink contained in the first chamber 310 first flows through a connecting hole 361 provided in the bottom of the first chamber 310 into the return flow path 321 of the second chamber 320, subsequently flows through the first flow path 323 and the second flow path 324 of the return flow path 321 and then flows through a supply port communicating path 370 to a liquid supply port 280. The ink then flows from the liquid supply port 280 and reaches a liquid introducing portion 640 provided in the holder 560 (shown in FIG. 4). When air bubbles are present in the second chamber 320, the air bubbles flow into the air bubble storage portion 325 and are accumulated in the space of the air bubble storage portion 325. According to the embodiment, the partition wall 330 that forms the upper surface of the first flow path 323 and the middle wall 331 that forms the upper surface of the second flow path 324 are inclined upward (to the +Z direction side) toward the air bubble storage portion 325. The air bubbles are thus likely to be flowed into the air bubble storage portion 325.

According to the embodiment, the connecting hole 361 has such dimensions and shape that do not allow for gas-liquid exchange between the first chamber 310 and the second chamber 320. According to the embodiment, the air bubbles in the second chamber 320 are thus unlikely to be flowed into the first chamber 310 but are likely to be flowed into the air bubble storage portion 325. The connecting hole 361 is preferably in a circular shape, an elliptical shape or a track-like shape having a maximum diameter of not less than 1 mm and not greater than 5 mm. The maximum diameter of less than 1 mm is likely to interfere with the flow of ink. The maximum diameter of greater than 5 mm is, on the other hand, likely to cause gas-liquid exchange. The connecting hole 361 formed in an angular shape such as a quadrilateral shape is also likely to cause gas-liquid exchange.

The cartridge 120A of the second embodiment described above has the similar functions and advantageous effects to those of the first embodiment. Additionally, the second chamber 320 has the space (air bubble storage portion 325) located on the +Z direction side of the return flow path 321. This configuration causes the air bubbles in the second chamber 320 to be moved to and accumulated in the space located on the +Z direction side of the return flow path 321 by using the buoyance of the air bubbles.

According to the embodiment, the space provided for accumulating the air bubbles is connected with the return flow path 321 in the middle of the return flow path 321. This configuration causes the air bubbles to be away from the first chamber 310 and the liquid supply port 280.

According to the embodiment, the connecting hole 361 has such dimensions and shape that do not allow for gas-liquid exchange between the first chamber 310 and the second chamber 320. This configuration suppresses the air bubbles from moving from the second chamber 320 to the first chamber 310 and makes the air bubbles more likely to be moved to the space of the air bubble storage portion 325.

C. Modifications of First and Second Embodiments

According to the above embodiments, the first flow path 323 in which the liquid flows from the third wall portion 203-side toward the fourth wall portion 204-side is located above (on the +Z direction side of) the second flow path 324 in which the liquid flows from the fourth wall portion 204-side toward the third wall portion 203-side. According to a modification, the first flow path 323 in which the liquid flows from the third wall portion 203-side toward the fourth wall portion 204-side may be located below (on the −Z direction side of) the second flow path 324 in which the liquid flows from the fourth wall portion 204-side toward the third wall portion 203-side. In this modification, the first flow path 323 and the second flow path 324 are connected with each other in the vertical direction (in the Z direction) at respective −X direction side ends. In this modification, it is preferable that a connecting hole 361 is provided at a position nearer to the fourth wall portion 204 than the third wall portion 203.

D. Third Embodiment

Figure 21:
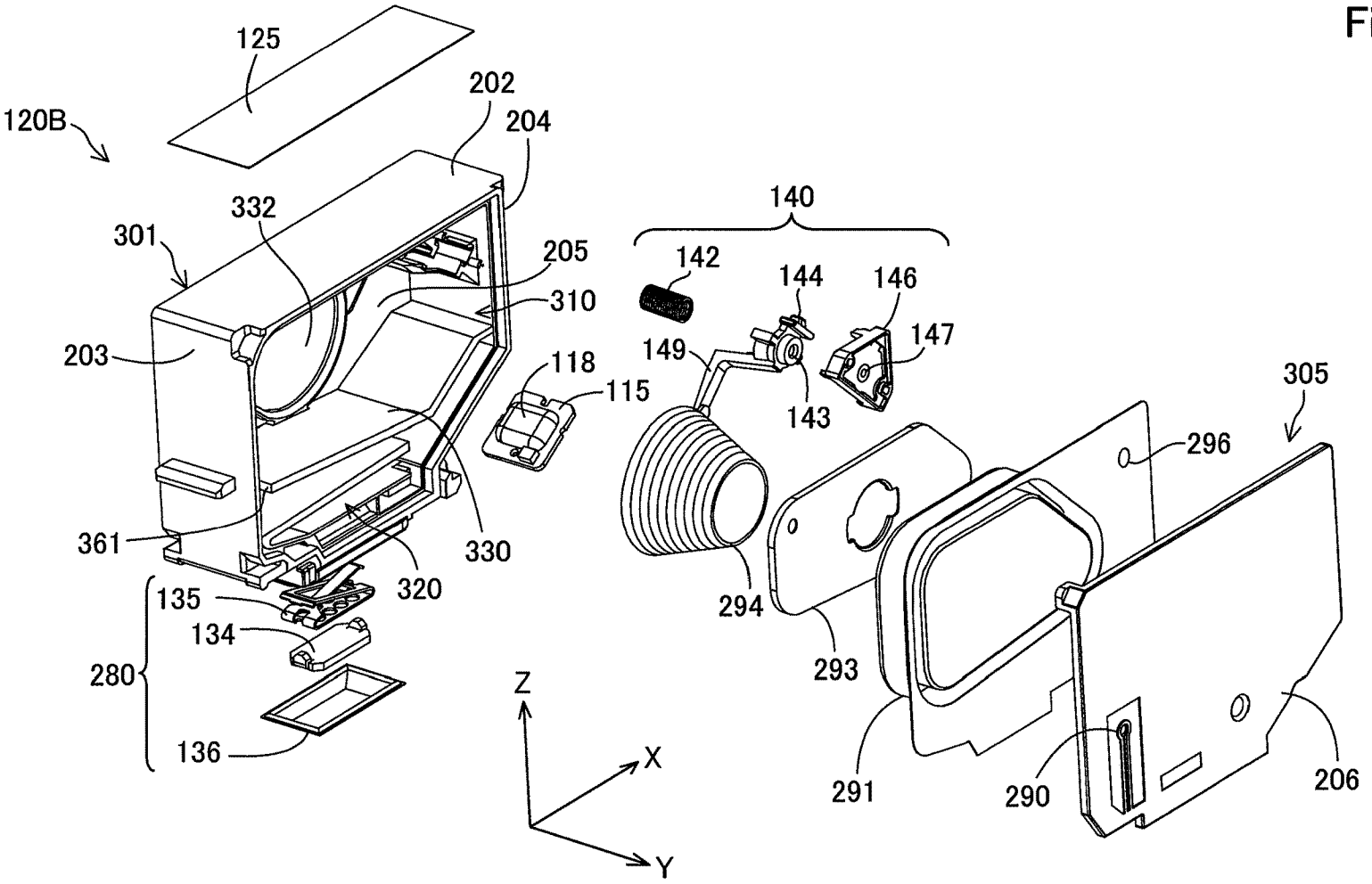
FIG. 21 is an exploded perspective view illustrating a cartridge according to a third embodiment.
Figure 22:
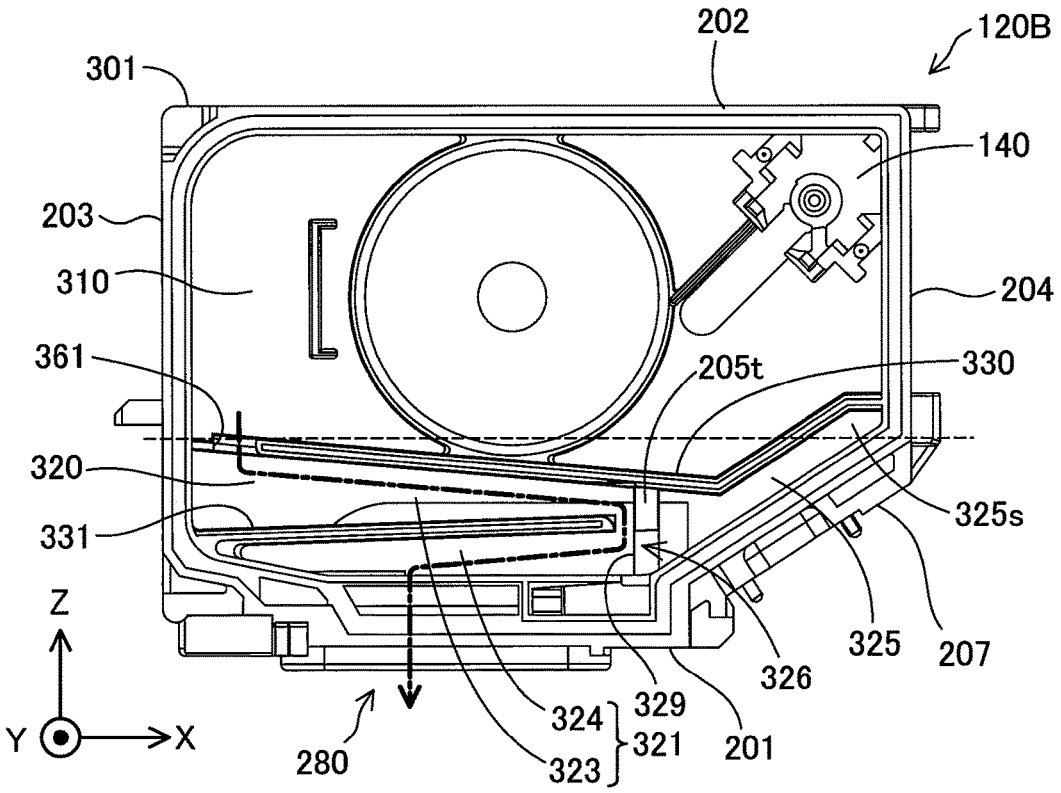
FIG. 22 is a front view illustrating a main body member according to the third embodiment.
Figure 23:
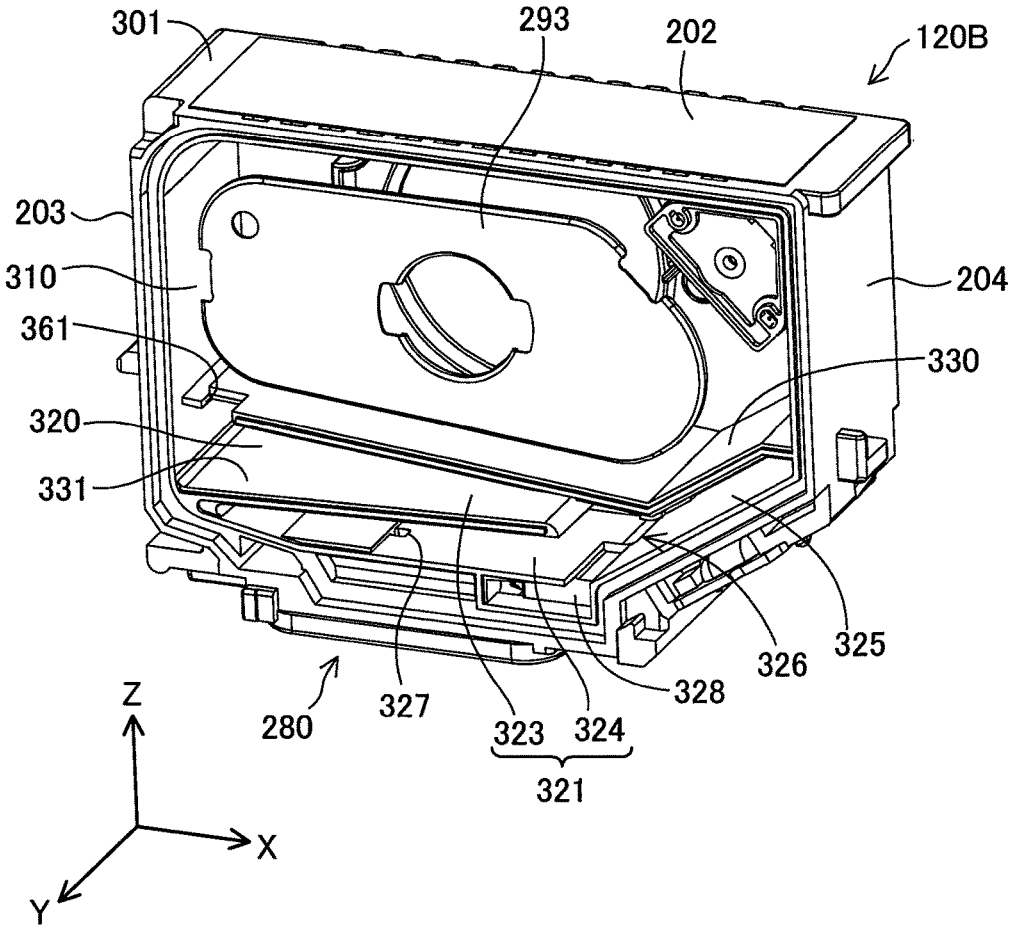
FIG. 23 is a perspective view illustrating the main body member according to the third embodiment.
Figure 24:
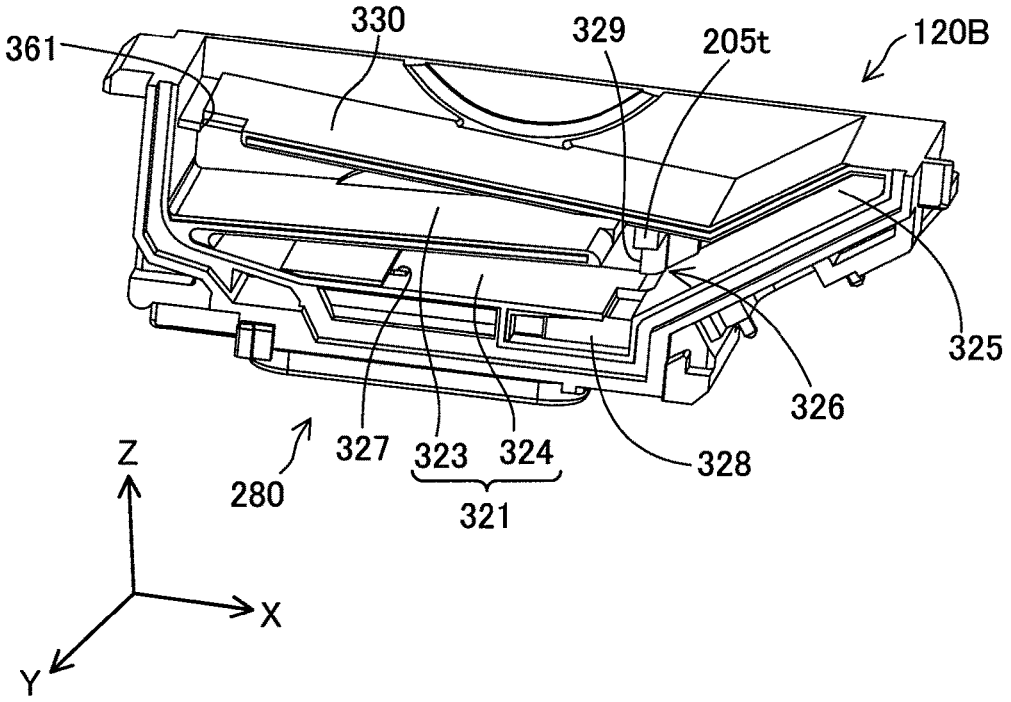
FIG. 24 is a perspective view illustrating periphery of a second chamber.
Figure 25:
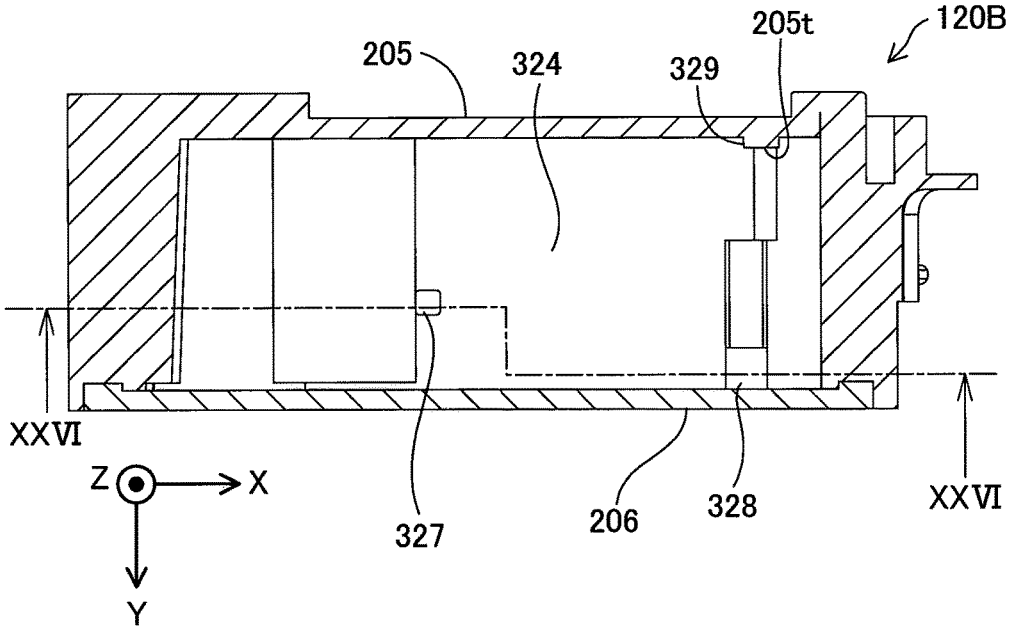
FIG. 25 is a diagram illustrating a second flow path viewed from the +Z direction side.
Figure 26:
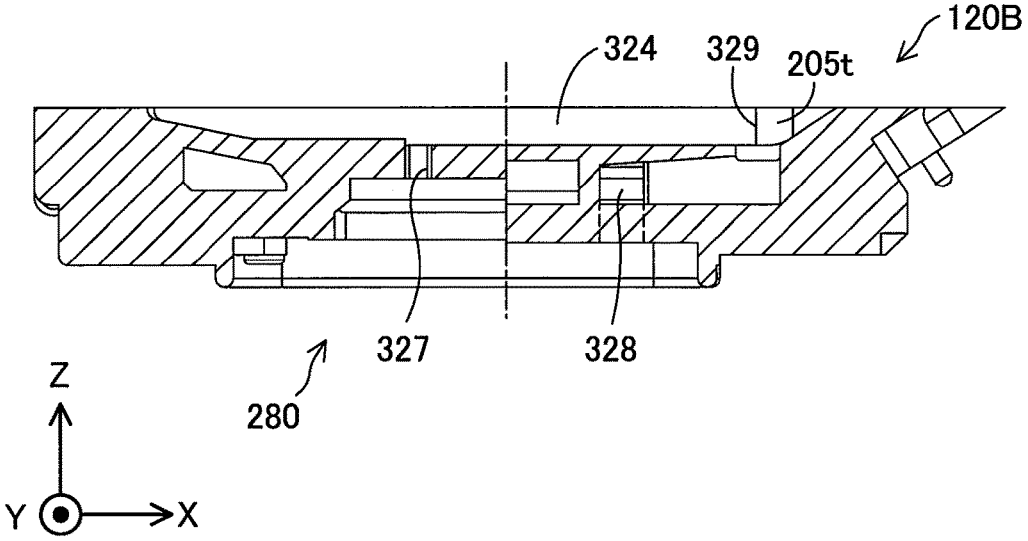
FIG. 26 is a sectional view taken along XXVI-XXVI in FIG. 25.

FIG. 21 is an exploded perspective view illustrating a cartridge 120B according to a third embodiment. FIG. 22 is a front view illustrating a main body member 301 according to the third embodiment. FIG. 23 is a perspective view illustrating the main body member 301 according to the third embodiment. FIG. 24 is a perspective view illustrating the periphery of a second chamber 320. FIG. 25 is a diagram illustrating a second flow path 324 viewed from the +Z direction side. FIG. 26 is a sectional view taken along XXVI-XXVI in FIG. 25.

A thick one-dot chain line arrow indicates the flow route of ink in FIG. 22. A first chamber 310 is formed on the +Z direction side of a partition wall 330 in the main body member 301. The first chamber 310 is a space of an approximately rectangular sectional shape surrounded by an inner surface of the second wall portion 202, an inner surface of the third wall portion 203, an inner surface of the fourth wall portion 204, an inner surface of the fifth wall portion 205 and an upper surface of the partition wall 330. The +Y direction side of the first chamber 310 is sealed by a sheet member 291 (shown in FIG. 21). A connecting hole 361 is provided at a position nearer to the third wall portion 203 than the fourth wall portion 204 in the bottom of the first chamber 310 to connect the first chamber 310 with a second chamber 320. This connecting hole 361 is an opening provided in the partition wall 330. Ink moves from the first chamber 310 through the connecting hole 361 to the second chamber 320 that is located below (on the −Z direction side of) the first chamber 310.

The second chamber 320 includes a return flow path 321 formed by turning back the flow path along the X direction. This return flow path 321 causes a plurality of flow paths along the X direction to be arrayed in the Z direction in the second chamber 320. A width along the X direction of the return flow path 321 is greater than a width along the X direction of a liquid supply port 280. The ink in the first chamber 310 is flowed from the connecting hole 361 through the return flow path 321 to the liquid supply port 280. According to this embodiment, the return flow path 321 includes a first flow path 323 in which ink flows from the third wall portion 203-side toward the fourth wall portion 204-side and a second flow path 324 in which ink flows from the fourth wall portion 204-side toward the third wall portion 203-side. The first flow path 323 communicates with the first chamber 310 via the connecting hole 361. The second flow path 324 is located below (on the −Z direction side of) the first flow path 323. A width along the Z direction of the first flow path 323 and the second flow path 324, i.e., the height of the flow path, is 2 to 3 mm. The first flow path 323 and the second flow path 324 are connected with each other in the vertical direction (in the Z direction) in the vicinity of respective +X direction side ends on the first wall portion 201. A portion where the first flow path 323 is connected with the second flow path 324 is called connecting portion 326. In the description below, a side of the return flow path 321 nearer to the first chamber 310 is called upstream side, and a side of the return flow path 321 nearer to the liquid supply port 280 is called downstream side.

According to this embodiment, the second chamber 320 includes an air bubble storage portion 325. The air bubble storage portion 325 includes a space 325*s* that is located on the +Z direction side of the return flow path 321. Air bubbles may be accumulated in the space of the air bubble storage portion 325 including the space 325*s*. The air bubble storage portion 325 is connected with the return flow path 321 in the middle of the return flow path 321. It is preferable that the air bubble storage portion 325 is connected with the return flow path 321 at a position far from an upstream end and a downstream end of the return flow path 321. According to the embodiment, the air bubble storage portion 325 is connected with the connecting portion 326 where the first flow path 323 is connected with the second flow path 324. The air bubble storage portion 325 is extended from the connecting portion 326 obliquely upward on the opposite side to the return flow path 321. The air bubble storage portion 325 has an upper surface that is formed by the partition wall 330 and a lower surface that is formed by the seventh wall portion 207.

According to this embodiment, a wall 331 (hereinafter called middle wall 331) that forms an upper surface of the second flow path 324, which is the most downstream flow path of the return flow path 321, includes a portion that is inclined to the +Z direction side from the downstream side toward the upstream side. The middle wall 331 may be entirely inclined or may include a non-inclined part. The partition wall 330 forms an upper surface of the first flow path 323, which is the most upstream flow path of the return flow path 321, and includes a portion that is inclined to the +Z direction side from the downstream side toward the upstream side. As described above, according to this embodiment, the partition wall 330 and the middle wall 331 that form the return flow path 321 have opposite inclinations. Accordingly, an extension along the inclination of the downstream side of the inclined portion of the partition wall 330 forming the return flow path 321 and an extension along the inclination of the upstream side of the inclined portion of the middle wall 331 forming the return flow path 321 intersect with each other.

According to the embodiment, as shown in FIGS. 23 to 26, a third flow path 327 and a fourth flow path 328 are provided between the second chamber 320 and the liquid supply port 280. The third flow path 327 is a flow path for ink delivery configured to deliver ink from the second chamber 320 to the liquid supply port 280. The fourth flow path 328 is a flow path for air delivery configured to deliver the air from the liquid supply port 280 to the second chamber 320. According to the embodiment, the fourth flow path 328 is provided on the upstream side of the third flow path 327. According to the embodiment, the fourth flow path 328 is provided at a position nearer to the connecting portion 326, compared with the third flow path 327. According to the embodiment, the fourth flow path 328 is accordingly provided at a position nearer to the air bubble storage portion 325, compared with the third flow path 327. The third flow path 327 is provided for ink delivery but the air may flow in the third flow path 327. The fourth flow path 328 is provided for air delivery but ink may flow in the fourth flow path 328.

According to the embodiment, as shown in FIG. 22 and FIGS. 24 to 26, a projection 205*t* is formed on an inner surface (+Y direction side surface) of the fifth wall portion 205 to be protruded toward the sixth wall portion 206. The projection 205*t* is extended from a lower surface of the partition wall 330 to a bottom face of the second flow path 324 in the Z direction. This projection 205*t* is located at a boundary between the air bubble storage portion 325 and the return flow path 321. The projection 205*t* includes an upper portion and a lower portion having different heights in the +Y direction from the fifth wall portion 205. More specifically, the height of the upper portion of the projection 205*t* opposed to the first flow path 323 in the X direction is greater than the height of the lower portion of the projection 205*t* opposed to the second flow path 324 in the X direction. According to another embodiment, the projection 205*t* may have a fixed height in the +Y direction.

According to the embodiment, the connecting portion 326 between the first flow path 323 and the second flow path 324 has a step 329 that is formed on the inner surface of the first side wall 205 to be extended in a direction from the upper wall 202 toward the bottom wall 201. In other words, the step 329 is formed at the connecting portion 326 along the direction of gravity on the inner surface of the first side wall 205. The step 329 forms a corner of a base end in the Y direction of the projection 205*t*. The ink flowing through the first flow path 323 is likely to flow to the second flow path 324 along this step 329. According to another embodiment, the step 329 may be provided independently of the projection 205*t*.

As shown in FIG. 22, the ink in the first chamber 310 is flowed from the connecting hole 361 through the return flow path 321 to the liquid supply port 280. More specifically, the ink in the first chamber 310 first flows through the connecting hole 361 provided in the bottom of the first chamber 310 into the return flow path 321 of the second chamber 320, subsequently flows through the first flow path 323 and the second flow path 324 of the return flow path 321 and then flows through the third flow path 327 to the liquid supply port 280. The ink then flows from the liquid supply port 280 and reaches the liquid introducing portion 640 provided in the holder 560 (shown in FIG. 4). Part of the ink may be flowed through the fourth flow path 328 to the liquid supply port 280.

Figure 27:
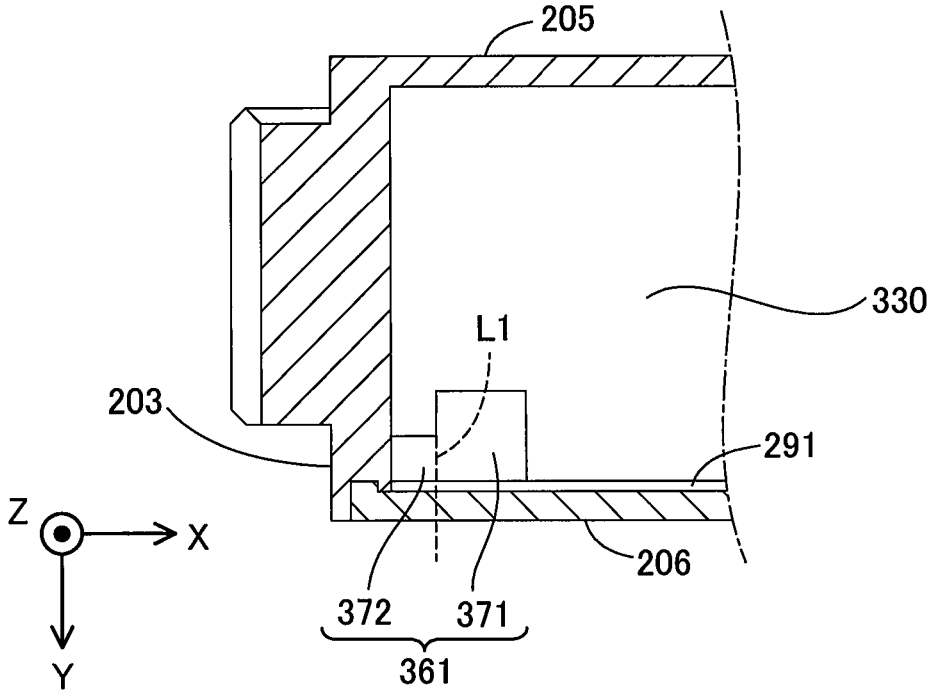
FIG. 27 is a diagram illustrating the flow path sectional shape of a connecting hole formed in a partition wall.

FIG. 27 is a diagram illustrating the flow path sectional shape of the connecting hole 361 formed in the partition wall 330. According to the embodiment, the flow path sectional shape of the connecting hole 361 includes at least a first polygon 371 and a second polygon 372 when the connecting hole 361 is viewed in the Z direction. The first polygon 371 and the second polygon 372 have different areas. According to the embodiment, the area of the first polygon 371 is larger than the area of the second polygon 372. The first polygon 371 and the second polygon 372 adjoin to each other on a straight line L1 along the Y direction. Accordingly, the flow path sectional shape of the connecting hole 361 is configured by combining polygons of different areas. The first polygon 371 and the second polygon 372 are both quadrilaterals and are approximate squares according to this embodiment. The first polygon 371 and the second polygon 372 are, however, not limited to quadrilaterals but may be other polygonal shapes such as triangles or pentagons.

According to this embodiment, the second polygon 372 of the smaller area is arranged to adjoin to the third wall portion 203 and the sixth wall portion 206 (or more specifically to the sheet member 291). The first polygon 371 is located on the fourth wall portion 204-side of the second polygon 372 to adjoin to the second polygon 372 and the sixth wall portion 206 (or more specifically to the sheet member 291). According to this embodiment, the first polygon 371 and the second polygon 372 are arrayed in the X direction and are joined with each other to form one figure. According to the embodiment, the figure formed by the first polygon 371 and the second polygon 372 is a concave polygon having at least one internal angle of larger than 180 degrees.

The first polygon 371 has such an area that enables air bubbles to be flowed from the second chamber 320-side through the first polygon 371 to the first chamber 310-side. The second polygon 372 has such an area that enables ink to be flowed from the first chamber 310-side through the second polygon 372 to the second chamber 320-side. Accordingly, the flow path sectional shape of the connecting hole 361 is a shape that enables ink and air bubbles to be flowed simultaneously (i.e., to allow for gas-liquid exchange).

Figure 28:
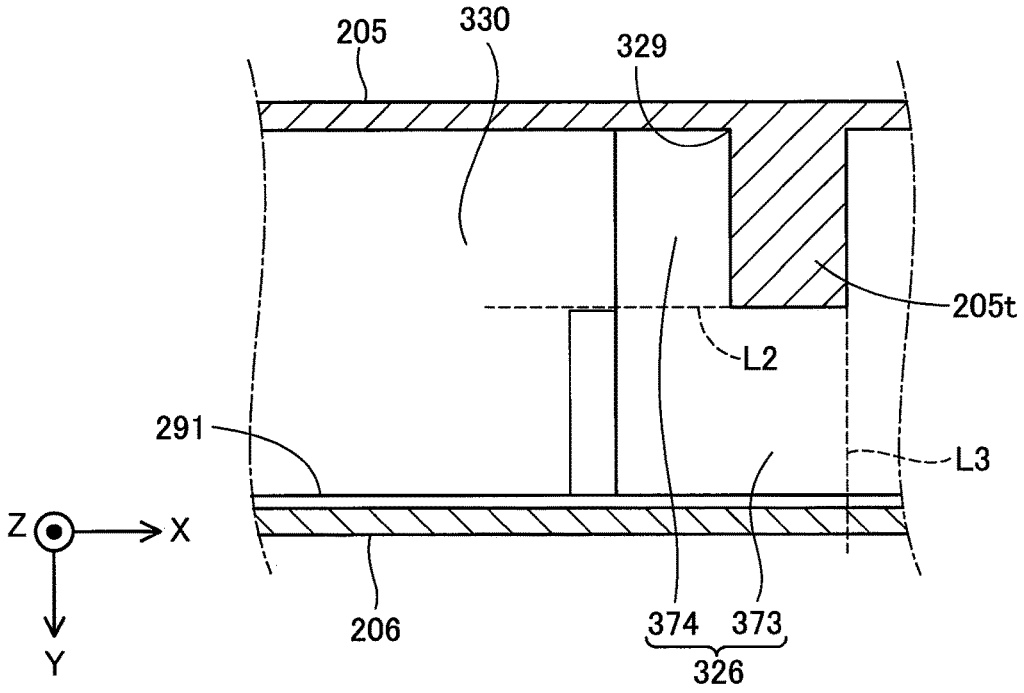
FIG. 28 is a diagram illustrating the flow path sectional shape of a connecting portion.

FIG. 28 is a diagram illustrating the flow path sectional shape of the connecting portion 326. According to the embodiment, the flow path sectional shape of the connecting portion 326 between the first flow path 323 and the second flow path 324 includes at least a third polygon 373 and a fourth polygon 374, when the connecting portion 326 is viewed in the Z direction. The third polygon 373 and the fourth polygon 374 have different areas. According to the embodiment, the area of the third polygon 373 is larger than the area of the fourth polygon 374. Accordingly, the flow path sectional shape of the connecting portion 326 is configured by combining polygons of different area. The third polygon 373 and the fourth polygon 374 are both quadrilaterals and are approximate rectangles according to this embodiment. The third polygon 373 and the fourth polygon 374 are, however, not limited to quadrilaterals but may be other polygonal shapes such as triangles or pentagons.

The fourth polygon 374 is defined by a +X direction side end of the partition wall 330, the fifth wall portion 205, a −X direction side surface of the projection 205*t*, and a straight line L2 along a +Y direction side surface of the projection 205*t*. The third polygon 373 is defined by the +X direction side end of the partition wall 330, the sixth wall portion 206 (or more specifically, the sheet member 291), the straight line L2 along the +Y direction side surface of the projection 205*t*, and a straight line L3 along a +X direction side surface of the projection 205*t*. According to this embodiment, the step 329 forms one corner of the fourth polygon 374.

According to the embodiment, the fourth polygon 374 of the smaller area is arranged to adjoin to the fifth wall portion 205. The third polygon 373 is placed between the fourth polygon 374 and the sixth wall portion 206 to adjoin to the fourth polygon 374. According to this embodiment, the third polygon 373 and the fourth polygon 374 are arrayed in the Y direction and are joined with each other to form one figure. According to the embodiment, the figure formed by the third polygon 373 and the fourth polygon 374 is a concave polygon having at least one internal angle of larger than 180 degrees.

The third polygon 373 has such an area that enables air bubbles to be flowed from the first flow path 323 through the third polygon 373 to the second flow path 324. The fourth polygon 374 has such an area that enables ink to be flowed from the first flow path 323 through the fourth polygon 374 to the second flow path 324. Accordingly, the flow path sectional shape of the connecting portion 326 is a shape that enables ink and air bubbles to be flowed simultaneously (i.e., to allow for gas-liquid exchange).

In the cartridge 120B of this embodiment described above, the first chamber 310 and the second chamber 320 are parted from each other by the partition wall 330 and are connected with each other via only the connecting hole 361. This configuration suppresses the air bubbles from entering the second chamber 320 even when ink undulates to generate air bubbles in the first chamber 310 accompanied with the reciprocating motion of the carriage 520 or the like. According to the embodiment, the second chamber 320 includes the return flow path 321, which is turned back along the X direction that is the moving direction of the carriage 520. This restricts the height of the flow path serving as the return flow path 321 and results in suppressing undulation of ink in the second chamber 320. Accordingly, this configuration suppresses ink from undulating to generate air bubbles in the second chamber 320. Additionally, according to the embodiment, ink in the first chamber 310 is introduced through the return flow path 321 to the liquid supply port 280. This configuration increases a time period until ink flowing out of the first chamber 310 reaches the liquid supply port 280. Even when air bubbles are mixed in the ink that flows from the first chamber 310 into the second chamber 320, this configuration increases the possibility that air bubbles naturally disappear before ink reaches the liquid supply port 280 and also increases the possibility that air bubbles are joined together to float to the first chamber 310 or to the air bubble storage portion 325. Accordingly, the configuration of the cartridge 120B of the embodiment reduces the possibility that air bubbles are mixed in the ink that is supplied from the cartridge 120B to the printer 150.

According to the embodiment, the flow path sectional shape of the connecting hole 361 provided to connect the first chamber 310 with the second chamber 320 includes the first polygon 371 and the second polygon 372 having different areas. This configuration causes, for example, ink to be flowed through the first polygon 371 of the smaller area while causing air bubbles to be flowed through the second polygon 372 of the larger area and thereby accelerates gas-liquid exchange in the connecting hole 361. This configuration accordingly suppresses air bubbles from reaching the liquid supply port 280 and more effectively reduces the possibility that air bubbles are mixed in the ink supplied from the cartridge 120B. According to the embodiment, the flow path section of the connecting hole 361 is formed in a polygonal shape, so that the flow path section has corners. Ink is concentrated in the corners by capillarity and is readily flowed through the connecting hole 361. The polygonal flow path sectional shape of the connecting hole 361 causes air bubbles to be more readily flowed through, compared with a circular flow path sectional shape.

According to the embodiment, out of the first polygon 371 and the second polygon 372 forming the flow path sectional shape of the connecting hole 361, the second polygon 372 which ink mainly flows through is located on the wall surface (third wall portion 203) side. This configuration causes ink to be readily flowed through the connecting hole 361 along the wall surface.

According to the embodiment, the return flow path 321 includes the first flow path 323 in which the liquid flows from the third side wall 203-side toward the fourth side wall 204-side and the second flow path 324 in which the liquid flows from the fourth side wall 204-side toward the third side wall 203-side. This configuration increases the flow path length of the return flow path 321. Accordingly, this increases the possibility that air bubbles disappear in the return flow path 321.

According to the embodiment, the flow path sectional shape of the connecting portion 326 between the first flow path 323 and the second flow path 324 viewed in the Z direction includes the third polygon 373 and the fourth polygon 374 having different areas. This configuration causes, for example, ink to be flowed through the fourth polygon 374 of the smaller area while causing air bubbles to be flowed through the third polygon 373 of the larger area and thereby accelerates gas-liquid exchange in the connecting portion 326 between the first flow path 323 and the second flow path 324. This configuration accordingly suppresses air bubbles from reaching the liquid supply port 280 and more effectively reduces the possibility that air bubbles are mixed in the ink supplied from the cartridge 120B. According to the embodiment, the flow path section of the connecting portion 326 is formed in a polygonal shape, so that the flow path section has corners. Ink is concentrated in the corners by capillarity and is readily flowed through the connecting portion 326. The polygonal flow path sectional shape of the connecting portion 326 causes air bubbles to be more readily flowed through, compared with a circular flow path sectional shape.

According to the embodiment, the connecting portion 326 between the first flow path 323 and the second flow path 324 has the step 329 that is formed on the inner surface of the fifth wall portion 205 to be extended in the direction from the second wall 202 toward the first wall portion 201. This configuration enables ink to be flowed along this step 329 and causes ink to be readily flowed from the first flow path 323 to the second flow path 324.

According to the embodiment, the second chamber 320 and the liquid supply port 280 are connected with each other by the third flow path 327 and the fourth flow path 328. For example, even when ink is supplied from the liquid supply port 280 in the state that the air is present in a connection between the liquid supply port 280 and the liquid introducing portion 640 (shown in FIG. 4), this configuration accelerates gas-liquid exchange between the second chamber 320 and the liquid supply port 280 and enables the air to be taken through the fourth flow path 328 into the cartridge 120B, while causing ink to be supplied through the third flow path 327. This configuration thus effectively reduces the possibility that air bubbles are mixed in the ink supplied from the cartridge 120B.

According to the embodiment, the fourth flow path 328 for air delivery is provided at a position nearer to the air bubble storage portion 325, compared with the third flow path 327 for ink delivery. This configuration enables air bubbles discharged from the fourth flow path 328 to be efficiently trapped in the air bubble storage portion 325.

According to the embodiment, the middle wall 331 that forms the upper surface of the most downstream side flow path (second flow path 324) of the return flow path 321 includes the portion that is inclined to the +Z direction side from the downstream side toward the upstream side. This configuration enables the air bubbles in the second chamber 320 to be moved to the upstream side by using the buoyance of the air bubbles.

According to the embodiment, the partition wall 330 forms the upper surface of the most upstream side flow path (first flow path 323) of the return flow path 321 and includes the portion that is inclined to the +Z direction side from the downstream side toward the upstream side. This configuration enables the air bubbles in the second chamber 320 to be moved to the upstream side by using the buoyance of the air bubbles.

According to the embodiment, the inner space volume of the second chamber 320 is larger than the inner space volume of the first chamber 310. This configuration increases a time period until air bubbles in the second chamber 320 are moved to the liquid supply port 280. This increases the possibility that the air bubbles naturally disappear and increases the possibility that the air bubbles are joined together to be bigger and to be discharged toward the first chamber 310.

According to the embodiment, the second chamber 320 has the air bubble storage portion 325 that includes the space 325*s* located on the +Z direction side of the return flow path 321 and causes air bubbles to be stored in this space 325*s*. This configuration enables the air bubbles in the second chamber 320 to be moved to the space 325*s* by using the buoyance of the air bubbles.

According to the embodiment, the space 325*s* is connected with the return flow path 321 in the middle of the return flow path 321. This configuration causes air bubbles to be away from the first chamber 310 and the liquid supply port 280. Accordingly, this configuration more effectively reduces the possibility that air bubbles are mixed in the ink supplied from the cartridge 120B.

E. Fourth Embodiment

Figure 29:
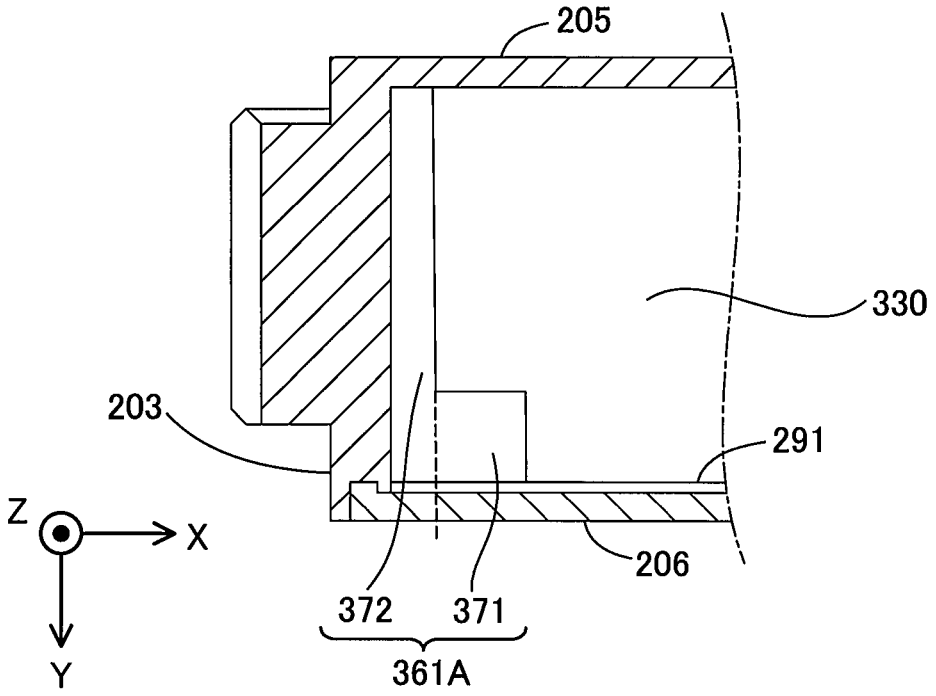
FIG. 29 is a diagram illustrating the flow path sectional shape of a connecting hole according to a fourth embodiment.

FIG. 29 is a diagram illustrating the flow path sectional shape of a connecting hole 361A according to a fourth embodiment. The fourth embodiment differs from the third embodiment by the configuration of the connecting hole in the cartridge 120B but otherwise has a similar configuration to that of the third embodiment. Like the third embodiment, the connecting hole 361A of the embodiment includes a first polygon 371 and a second polygon 372 when the connecting hole 361A is viewed in the Z direction. According to the embodiment, however, the area of the second polygon 372 is larger than the area of the first polygon 371, and the second polygon 372 is formed in a shape that adjoins to the entire inner surface of the third wall portion 203. This configuration of the connecting hole 361A causes air bubbles to be flowed through the first polygon 371, while causing ink to be flowed through the second polygon 372. This accordingly accelerates gas-liquid exchange between the first chamber 310 and the second chamber 320.

F. Fifth Embodiment

Figure 30:
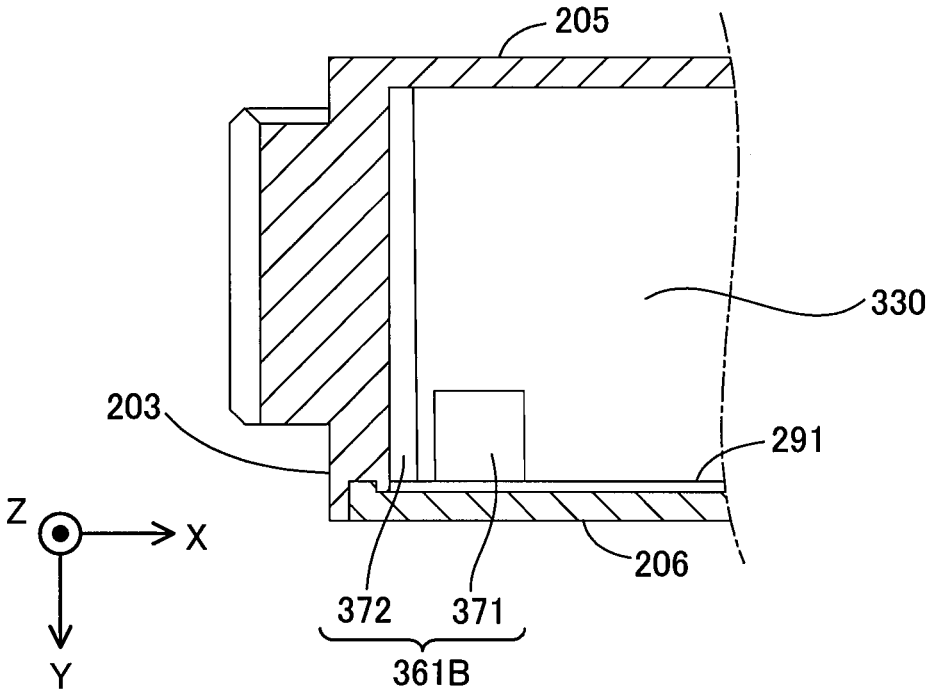
FIG. 30 is a diagram illustrating the flow path sectional shape of a connecting hole according to a fifth embodiment.

FIG. 30 is a diagram illustrating the flow path sectional shape of a connecting hole 361B according to a fifth embodiment. The fifth embodiment differs from the third embodiment by the configuration of the connecting hole in the cartridge 120B but otherwise has a similar configuration to that of the third embodiment. Like the third embodiment and the fourth embodiment, the connecting hole 361B of the embodiment includes a first polygon 371 and a second polygon 372 when the connecting hole 361B is viewed in the Z direction. According to the embodiment, however, the first polygon 371 and the second polygon 372 are separated from each other. This configuration causes air bubbles to be flowed through the first polygon 371, while causing ink to be flowed through the second polygon 372. This accordingly accelerates gas-liquid exchange between the first chamber 310 and the second chamber 320.

G. Sixth Embodiment

Figure 31:
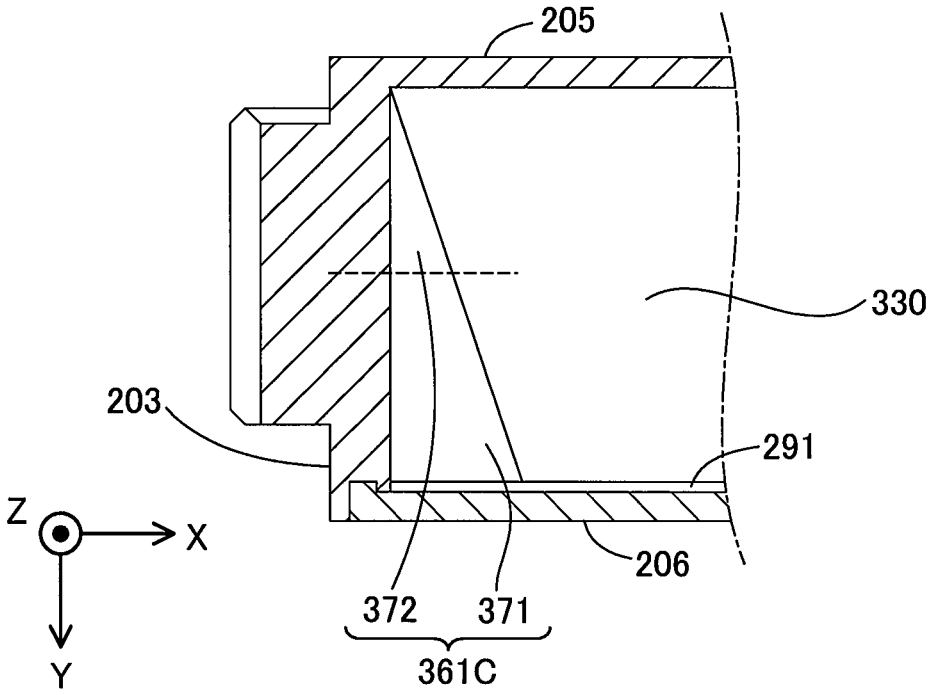
FIG. 31 is a diagram illustrating the flow path sectional shape of a connecting hole according to a sixth embodiment.

FIG. 31 is a diagram illustrating the flow path sectional shape of a connecting hole 361C according to a sixth embodiment. The sixth embodiment differs from the third embodiment by the configuration of the connecting hole in the cartridge 120B but otherwise has a similar configuration to that of the third embodiment. Like the third embodiment, the connecting hole 361C of the embodiment includes a first polygon 371 and a second polygon 372 when the connecting hole 361C is viewed in the Z direction. According to the embodiment, however, the first polygon 371 is a quadrilateral, and the second polygon 372 is a triangle. The connecting hole 361C is configured as one large triangle by combining the first polygon 371 with the second polygon 372. This configuration causes air bubbles to be flowed through a portion of the connecting hole 361C corresponding to the first polygon 371, while causing ink to be flowed through a portion of the connecting hole 361C corresponding to the second polygon 372. This accordingly accelerates gas-liquid exchange between the first chamber 310 and the second chamber 320.

The flow path sectional shapes of the connecting holes 361B and 361C of the fifth embodiment and the sixth embodiment described above are applicable to the flow path sectional shape of the connecting portion 326 provided to connect the first flow path 323 with the second flow path 324. For example, the flow path sectional shape of the connecting portion 326 may include a third polygon 373 and a fourth polygon 374 that are separated from each other. In another example, the flow path sectional shape of the connecting portion 326 may be one triangle formed by combining a third polygon 373 with a fourth polygon 374.

H. Seventh Embodiment

Figure 32:
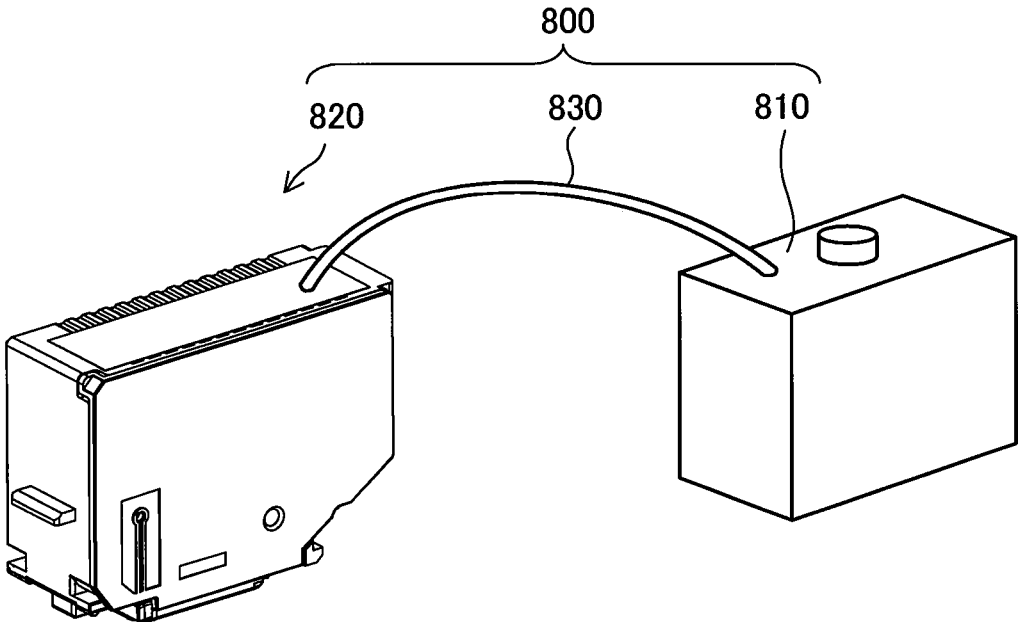
FIG. 32 is a diagram illustrating the configuration of a liquid supply unit according to a seventh embodiment.

FIG. 32 is a diagram illustrating the configuration of a liquid supply unit 800 according to a seventh embodiment. This liquid supply unit 800 includes a liquid bottle 810, a cartridge 820 and a liquid supply tube 830. The cartridge 820 has a similar configuration to those of the cartridges of the first to the sixth embodiments, except that the liquid supply tube 830 is connected with the cartridge 820.

The liquid supply tube 830 connects the liquid bottle 810 with the first chamber 310 (shown in FIGS. 15 and 22) included in the cartridge 820. A liquid (ink) is contained in the liquid bottle 810. The liquid bottle 810 may be appropriately refilled with the liquid. The liquid bottle 810 is placed outside of the printer 150. The liquid contained in the liquid bottle 810 is supplied through the liquid supply tube 830 to the first chamber 310 in the cartridge 820. In this liquid supply unit 800, the configuration of the respective parts of the cartridge 820 is similar to those of the cartridges of the first to the sixth embodiments. Accordingly the configuration of the seventh embodiment has similar functions and advantageous effects to those of the first to the sixth embodiments.

I. Modifications of Third to Seventh Embodiments

In the above embodiments, the flow path sectional shape of the connecting portion 326 may be a shape that does not include a plurality of polygons (third polygon 373 and fourth polygon 374). In other words, the flow path sectional shape of the connecting portion 326 may be a simple shape such as a quadrilateral shape or a circular shape.

In the above embodiments, the connecting portion 326 may not include the step 329.

In the above embodiments, the step 329 is provided by forming the projection 205*t* on the inner surface of the fifth wall portion 205. For example, a step may be provided by forming a groove in the fifth wall portion 205 in a direction from the upper wall 202 toward the bottom wall 201.

In the above embodiments, only one of the third flow path 327 and the fourth flow path 328 may be provided between the second chamber 320 and the liquid supply port 280.

In the above embodiments, the middle wall 331 may be inclined to the −Z direction side from the downstream side toward the upstream side of the return flow path 321.

In the above embodiments, the partition wall 330 may be inclined to the −Z direction side from the downstream side toward the upstream side of the return flow path 321.

In the above embodiments, the cartridge 120B may not be provided with the air bubble storage portion 325.

In the above embodiments, the air bubble storage portion 325 may be connected with the return flow path 321 at an upstream end or at a downstream end, instead of in the middle of the return flow path 321.

In the above embodiments, as long as at least one requirement is met among the following three requirements, the other two requirements may not be necessarily met:

(1) The flow path sectional shape of the connecting hole 361 includes the first polygon 371 and the second polygon 372;

(2) The flow path sectional shape of the connecting portion 326 includes the third polygon 373 and the fourth polygon 374; and (3) The third flow path 327 and the fourth flow path 328 are included between the second chamber 320 and the liquid supply port 280.

J. Other Embodiments

According to the above embodiments, the return flow path 321 is configured by turning back the flow path once. According to another embodiment, the return flow path 321 may be configured by turning back the flow path twice or more. In other words, the return flow path 321 may include additional flow paths, in addition to the first flow path 323 and the second flow path 324.

According to the above embodiments, the cartridge 120 is defined and formed by the seven wall portions 201 to 207. The number of wall portions defining and forming the cartridge 120 is, however, not limited to seven, as long as the wall portions are arranged to form a space for containing ink inside thereof. For example, the cartridge 120 may be defined and formed by six or a less number of wall portions or may be defined and formed by eight or a greater number of wall portions. The cartridge 120 may also be defined and formed by one or more spherical or curved wall portions. The cartridge 120 may further be defined and formed by a combination of a curved wall portion with a plate-like wall portion.

The configuration of the cartridge 120 according to each of the embodiments described above may be divided into a liquid container member and an adapter. The adapter is provided with various engagement members to be engaged with the holder 560 of the printer 150 and is configured as a member to receive therein the liquid container body in a separable manner. In this embodiment, for example, a preferable configuration is that the liquid container body is provided with the first liquid chamber 310, the second liquid chamber 320 and the liquid supply port 280 and that the adapter is provided with the substrate 115 including the storage device 118.

The disclosure is not limited to the printer or the ink cartridge thereof but is also applicable to any liquid ejection apparatuses consuming liquids other than ink and cartridges used for such liquid ejection apparatuses. For example, the disclosure may be applied to cartridges used for various liquid ejection apparatuses described below:

(1) image recording apparatus such as facsimile machine;

(2) color material ejection apparatus used for manufacturing color filters for image display apparatuses such as liquid crystal displays;

(3) electrode material ejection apparatus used for forming electrodes of, for example, organic EL (electroluminescence) displays and field emission displays (FED);

(4) liquid ejection apparatus configured to eject a bioorganic material-containing liquid used for manufacturing biochips;

(5) sample ejection apparatus used as precision pipette;

(6) ejection apparatus of lubricating oil;

(7) ejection apparatus of resin solutions;

(8) liquid ejection apparatus for pinpoint ejection of lubricating oil on precision machines such as watches and cameras;

(9) liquid ejection apparatus configured to eject transparent resin solutions, such as ultraviolet curable resin solution, onto substrates to manufacture hemispherical microlenses (optical lenses) used for, for example, optical communication elements;

(10) liquid ejection apparatus configured to eject acidic or alkaline etching solutions to etch substrates and the like; and

(11) liquid ejection apparatus equipped with a liquid consuming head configured to eject a very small volume of droplets of any other liquid.

The "droplet" herein means the state of liquid ejected from the liquid ejection apparatus and may be in a granular shape, a teardrop shape or a tapered threadlike shape. The "liquid" herein may be any material consumable by the liquid ejection apparatus. The "liquid" may be any material in the liquid phase. For example, the "liquid" may be any material in the liquid phase. Liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with solvents. Typical examples of the liquid include ink described in the above embodiments and liquid crystal. The ink herein includes general water-based inks and oil-based inks, as well as various liquid compositions, such as gel inks and hot-melt inks.

The present disclosure is not limited to any of the embodiments described above but may be implemented by a diversity of configurations without departing from the scope of the disclosure. For example, the technical features of any of the embodiments corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A liquid container configured to be mounted to a carriage that reciprocates in an X direction, the liquid container comprising:

an upper wall and a bottom wall opposed to each other in a Z direction that intersects with the X direction;

a first side wall and a second side wall opposed to each other in a Y direction that intersects with the X direction and the Z direction;

a third side wall and a fourth side wall opposed to each other in the X direction;

a liquid supply port provided in the bottom wall;

a first chamber provided on a +Z direction side that is an upper wall side in the Z direction;

a second chamber provided on a −Z direction side that is a bottom wall side in the Z direction;

a partition wall configured to part the first chamber from the second chamber; and a connecting hole configured to connect the first chamber with the second chamber, wherein the second chamber is connected with the liquid supply port, the first chamber is connected with the liquid supply port via the connecting hole and the second chamber, the second chamber includes a return flow path that is turned back along the X direction, a liquid contained in the first chamber is flowed from the connecting hole through the return flow path to the liquid supply port, and the return flow path includes a first flow path in which the liquid flows from the third side wall toward the fourth side wall, and a second flow path in which the liquid flows from the fourth side wall toward the third side wall.

2. The liquid container according to claim 1, wherein the first chamber is provided with an air introducing hole configured to introduce the air from outside of the first chamber into the first chamber.

3. The liquid container according to claim 1, wherein when a first chamber side of the return flow path is called upstream side and a liquid supply port side of the return flow path is called downstream side, a wall that forms an upper surface of a most downstream side flow path of the return flow path includes an inclined portion that is inclined to the +Z direction side from the downstream side toward the upstream side.

4. The liquid container according to claim 3, wherein the partition wall forms an upper surface of a most upstream flow path of the return flow path, and the partition wall includes an inclined portion that is inclined to the +Z direction side from the downstream side toward the upstream side.

5. The liquid container according to claim 4, wherein the connecting hole has such dimensions and shape that allow for gas-liquid exchange between the first chamber and the second chamber.

6. A liquid container configured to be mounted to a carriage that reciprocates in an X direction, the liquid container comprising:

an upper wall and a bottom wall opposed to each other in a Z direction that intersects with the X direction;

a first side wall and a second side wall opposed to each other in a Y direction that intersects with the X direction and the Z direction;

a third side wall and a fourth side wall opposed to each other in the X direction;

a liquid supply port provided in the bottom wall;

a first chamber provided on a +Z direction side that is an upper wall side in the Z direction;

a second chamber provided on a −Z direction side that is a bottom wall side in the Z direction;

a partition wall configured to part the first chamber from the second chamber; and a connecting hole configured to connect the first chamber with the second chamber, wherein the second chamber is connected with the liquid supply port, the first chamber is connected with the liquid supply port via the connecting hole and the second chamber, the second chamber includes a return flow path that is turned back along the X direction, a liquid contained in the first chamber is flowed from the connecting hole through the return flow path to the liquid supply port, and the second chamber includes a space that is located on the +Z direction side of the return flow path and that is configured to accumulate air bubbles therein.

7. The liquid container according to claim 6, wherein the space is connected with the return flow path in the middle of the return flow path.

8. The liquid container according to claim 7, wherein the connecting hole has such dimensions and shape that do not allow for gas-liquid exchange between the first chamber and the second chamber.

9. A liquid container configured to be mounted to a carriage that reciprocates in an X direction, the liquid container comprising:

an upper wall and a bottom wall opposed to each other in a Z direction that intersects with the X direction;

a first side wall and a second side wall opposed to each other in a Y direction that intersects with the X direction and the Z direction;

a third side wall and a fourth side wall opposed to each other in the X direction;

a liquid supply port provided in the bottom wall;

a first chamber provided on a +Z direction side that is an upper wall side in the Z direction;

a second chamber provided on a −Z direction side that is a bottom wall side in the Z direction;

a partition wall configured to part the first chamber from the second chamber; and a connecting hole configured to connect the first chamber with the second chamber, wherein the second chamber is connected with the liquid supply port, the first chamber is connected with the liquid supply port via the connecting hole and the second chamber, the second chamber includes a return flow path that is turned back along the X direction, a liquid contained in the first chamber is flowed from the connecting hole through the return flow path to the liquid supply port, and the connecting hole has a flow path sectional shape including at least a first polygon and a second polygon when the connecting hole is viewed in the Z direction, wherein the first polygon and the second polygon have different areas.

10. The liquid container according to claim 9, wherein the return flow path includes a first flow path in which the liquid flows from the third side wall toward the fourth side wall, and a second flow path in which the liquid flows from the fourth side wall toward the third side wall.

11. The liquid container according to claim 10, wherein a connecting portion between the first flow path and the second flow path has a flow path sectional shape including at least a third polygon and a fourth polygon when the connecting portion is viewed in the Z direction, wherein the third polygon and the fourth polygon have different areas.

12. The liquid container according to claim 10, wherein a connecting portion between the first flow path and the second flow path includes a step that is formed on an inner surface of at least one of the first side wall and the second side wall to be extended in a direction from the upper wall toward the bottom wall.

13. The liquid container according to claim 9, wherein a third flow path for liquid delivery configured to deliver the liquid from the second chamber to the liquid supply port and a fourth flow path for air delivery configured to deliver the air from the liquid supply port to the second chamber are provided between the second chamber and the liquid supply port.

14. The liquid container according to claim 9, wherein when a first chamber side of the return flow path is called upstream side and a liquid supply port side of the return flow path is called downstream side, a wall that forms an upper surface of a most downstream side flow path of the return flow path includes an inclined portion that is inclined to the +Z direction side from the downstream side toward the upstream side.

15. The liquid container according to claim 9, wherein the partition wall forms an upper surface of a most upstream flow path of the return flow path, and the partition wall includes an inclined portion that is inclined to the +Z direction side from a downstream side toward an upstream side.

16. The liquid container according to claim 9, wherein the second chamber is provided with an air bubble storage portion including a space that is located on the +Z direction side of the return flow path and that is configured to accumulate air bubbles therein.

17. The liquid container according to claim 16, wherein the air bubble storage portion is connected with the return flow path in the middle of the return flow path.

18. The liquid container according to claim 1, wherein a connecting portion between the first flow path and the second flow path has a flow path sectional shape including at least two polygons having different areas when the connecting portion is viewed in the Z direction.

19. The liquid container according to claim 1, wherein a flow path for liquid delivery configured to deliver the liquid from the second chamber to the liquid supply port and a flow path for air delivery configured to deliver the air from the liquid supply port to the second chamber are provided between the second chamber and the liquid supply port.

* * * * *